US009740158B2

(12) United States Patent
Kosaka

(10) Patent No.: US 9,740,158 B2
(45) Date of Patent: Aug. 22, 2017

(54) POWER SUPPLY UNIT AND IMAGE FORMING APPARATUS

(71) Applicant: Oki Data Corporation, Tokyo (JP)

(72) Inventor: Toru Kosaka, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/131,766

(22) Filed: Apr. 18, 2016

(65) Prior Publication Data

US 2016/0378052 A1 Dec. 29, 2016

(30) Foreign Application Priority Data

Jun. 23, 2015 (JP) ..... 2015-125668

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01)

(58) Field of Classification Search
CPC ..... G03G 15/80
USPC ..... 399/69, 70, 88
See application file for complete search history.

(56) References Cited

U.S. PATENT DOCUMENTS

2004/0258426 A1* 12/2004 Kishi ..... G03G 15/2039 399/69
2005/0082276 A1 4/2005 Hirst
2012/0243262 A1* 9/2012 Ger ..... H02M 3/33507 363/15
2013/0136467 A1 5/2013 Naganawa

FOREIGN PATENT DOCUMENTS

JP 2007-199357 A 8/2007
JP 2013-235107 A 11/2013

* cited by examiner

*Primary Examiner* — Sandra Brase
(74) *Attorney, Agent, or Firm* — Rabin & Berdo, P.C.

(57) ABSTRACT

Provided is a power supply unit that includes a switching section and a controller. The switching section is configured to perform a switching operation and thereby generate, based on an input signal, a first alternating-current signal. The controller is configured to control the switching operation and thereby perform an amplitude control that involves increasing, based on an input current in the switching section, a signal amplitude of the first alternating-current signal.

14 Claims, 30 Drawing Sheets

| HEATER CONTROL SIGNAL HA (INTERNAL SIGNAL HA2) | | HEATER CONTROL SIGNAL HB (INTERNAL SIGNAL HB2) | | OPERATION |
|---|---|---|---|---|
| PREVIOUS VALUE | CURRENT VALUE | PREVIOUS VALUE | CURRENT VALUE | |
| L | L | L | L | STOP |
| L | L | L | H | SLOW-UP CONTROL |
| L | L | H | L | STOP |
| L | L | H | H | MAINTAIN |
| L | H | L | L | SLOW-UP CONTROL |
| L | H | L | H | SLOW-UP CONTROL |
| L | H | H | L | SLOW-UP CONTROL |
| L | H | H | H | SLOW-UP CONTROL |
| H | L | L | L | STOP |
| H | L | L | H | SLOW-UP CONTROL |
| H | L | H | L | STOP |
| H | L | H | H | MAINTAIN |
| H | H | L | L | MAINTAIN |
| H | H | L | H | SLOW-UP CONTROL |
| H | H | H | L | MAINTAIN |
| H | H | H | H | MAINTAIN |

FIG. 21

| | |
|---|---|
| READ CMMAND | STATUS COMMAND |
| | INPUT VOLTAGE COMMAND |
| | INPUT CURRENT COMMAND |
| | OUTPUT CURRENT COMMAND |

| | |
|---|---|
| WRITE COMMAND | CURRENT LIMIT COMMAND |
| | TARGET VOLTAGE COMMAND |
| | STARTING VOLTAGE COMMAND |
| | CONTROL CYCLE COMMAND |
| | OUTPUT STANDBY COMMAND |
| | OUTPUT OFF COMMAND |

FIG. 29

POWER SUPPLY UNIT AND IMAGE FORMING APPARATUS

CROSS REFERENCE TO RELATED APPLICATIONS

This application claims the benefit of Japanese Priority Patent Application JP2015-125668 filed on Jun. 23, 2015, the entire contents of which are incorporated herein by reference.

BACKGROUND

The invention relates to a power supply unit that supplies a load with electric power, and to an image forming apparatus that includes the power supply unit.

An image forming apparatus transfers a toner image formed on a photosensitive drum onto a recording medium and fixes the transferred toner image to the recording medium in a fixing section. The fixing section is provided with a heater, and applies heat and pressure to the recording medium and thereby fixes the toner image to the recording medium. To control a temperature of the heater, an effective value of an alternating-current signal to be supplied thereto may be controlled. In general, a phase control or a frequency control may be performed to control the effective value of the alternating-current signal. For example, Japanese Unexamined Patent Application Publication No. 2013-235107 discloses an image forming apparatus that performs the phase control with use of a triac upon supplying a heater with an alternating-current signal supplied from a commercial power supply.

SUMMARY

At start of electric power supply to a heater, there may be a possibility of an occurrence of a large rush current, resulting in an occurrence of a flicker. On the other hand, to perform the phase control to restrain the rush current may lead to a possibility of an occurrence of a conduction noise. What is therefore desired in the electric power supply to the heater is to reduce a possibility of an occurrence of the conduction noise, the flicker, or both.

It is desirable to provide a power supply unit and an image forming apparatus that make it possible to reduce a possibility of an occurrence of a conduction noise, a flicker, or both.

A power supply unit according to an illustrative embodiment of the invention includes: a switching section; and a controller. The switching section is configured to perform a switching operation to generate, based on an input signal, a first alternating-current signal. The controller is configured to control the switching operation to perform an amplitude control that involves increasing, based on an input current in the switching section, a signal amplitude of the first alternating-current signal.

An image forming apparatus according to an illustrative embodiment of the invention includes: a developing unit; a fixing unit; and a power supply unit. The fixing unit includes a heater, and is configured to fix a developer onto a recording medium. The power supply unit is configured to supply the heater with electric power, and includes: a switching section; and a controller. The switching section is configured to perform a switching operation to generate, based on an input signal, a first alternating-current signal. The controller is configured to control the switching operation to perform an amplitude control that involves increasing, based on an input current in the switching section, a signal amplitude of the first alternating-current signal.

BRIEF DESCRIPTION OF THE DRAWINGS

FIG. 21 is a table that summarizes an example of operations of the control circuit illustrated in FIG. 8.

FIG. 29 is a table provided for description of a write command.

DETAILED DESCRIPTION

In the following, some example embodiments of the invention are described in detail with reference to the accompanying drawings. Note that the following description is directed to illustrative examples of the invention and not to be construed as limiting to the invention. Also, factors such as arrangement, dimensions, and a dimensional ratio of elements illustrated in each drawing are illustrative only and not to be construed as limiting to the invention.

CONFIGURATION EXAMPLE

Example of Overall Configuration

Figure 1:
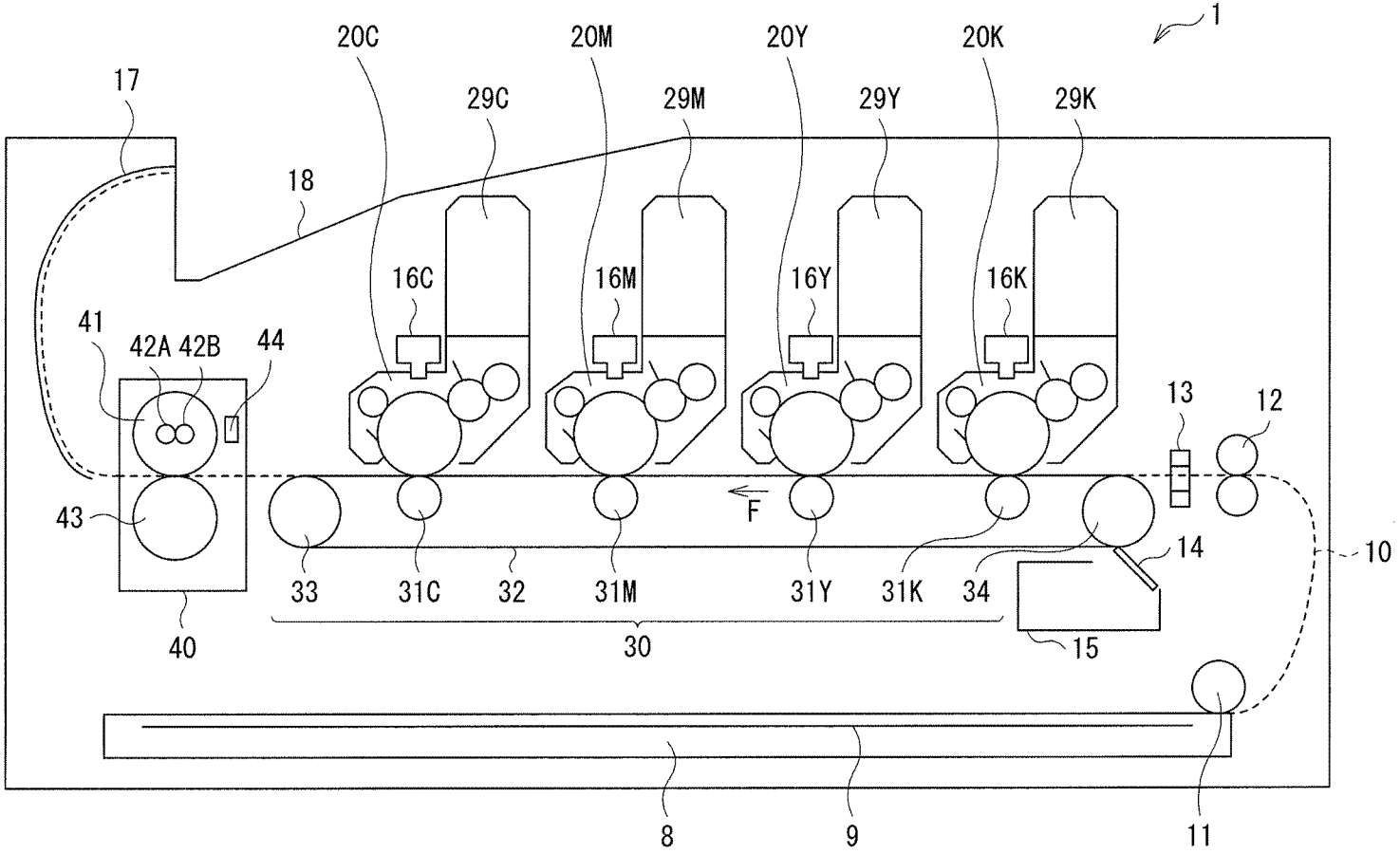
FIG. 1 illustrates an example of a configuration of an image forming apparatus according to an example embodiment of the invention.

FIG. 1 schematically illustrates an example of a configuration of an image forming apparatus (image forming apparatus 1) that includes a power supply unit according to an example embodiment of the invention. The image forming apparatus 1 may function as a printer that forms an image on a recording medium 9 with use of an electrophotographic process. The recording medium 9 may be, for example but not limited to, paper including plain paper or any other medium on which an image is to be formed.

Referring to FIG. 1, the image forming apparatus 1 may include a hopping roller 11, a resist roller 12, a medium sensor 13, developing sections 20, toner containers 29, exposure heads 16, a transfer section 30, and a fixing section 40. In this example embodiment, four developing sections 20 (developing sections 20C, 20M, 20Y, and 20K), four toner containers 29 (toner containers 29C, 29M, 29Y, and 29K), and four exposure heads 16 (16C, 16M, 16Y, and 16K) are provided, although the number of each of which is not limited thereto. These members may be disposed along a conveying path 10 along which the recording medium 9 is to be conveyed.

The hopping roller 11 may be a member that takes the recording medium 9 stored in a medium feeding cassette (paper feeding cassette) 8 out of the medium feeding cassette 8 one by one from the top, and feeds the taken out recording medium 9 to the conveying path 10. The medium feeding cassette 8 may be attachable to and detachable from the image forming apparatus 1. The hopping roller 11 may be rotated by means of drive power transmitted from a hopping motor 11T to be described later.

The resist roller 12 may be a member configured by a pair of rollers that are provided with the conveying path 10 interposed therebetween. The resist roller 12 may correct skew of the recording medium 9 fed from the hopping roller 11, and guide the corrected recording medium 9 to the developing section 20 along the conveying path 10. The resist roller 12 may be rotated by means of drive power transmitted from a resist motor 12T to be described later.

The medium sensor 13 may detect, in a contact fashion or in a contactless fashion, passing of the recording medium 9 therethrough.

The developing section 20 may form toner images. In one specific but non-limiting example, the developing section 20C may form a cyan (C) toner image, the developing section 20M may form a magenta (M) toner image, the developing section 20Y may form a yellow (Y) toner image, and the developing section 20K may form a black (K) toner image. In this example, the developing sections 20 may be disposed in order of the developing sections 20K, 20Y, 20M, and 20C in a conveying direction "F" of the recording medium 9. The developing sections 20 each may be attachable to and detachable from the image forming apparatus 1.

The toner container 29C may contain a cyan (C) toner, and may be attachable to and detachable from the developing section 20C. Similarly, the toner container 29M may contain a magenta (M) toner, and may be attachable to and detachable from the developing section 20M. The toner container 29Y may contain a yellow (Y) toner, and may be attachable to and detachable from the developing section 20Y. The toner container 29K may contain a black (K) toner, and may be attachable to and detachable from the developing section 20K.

Figure 2:
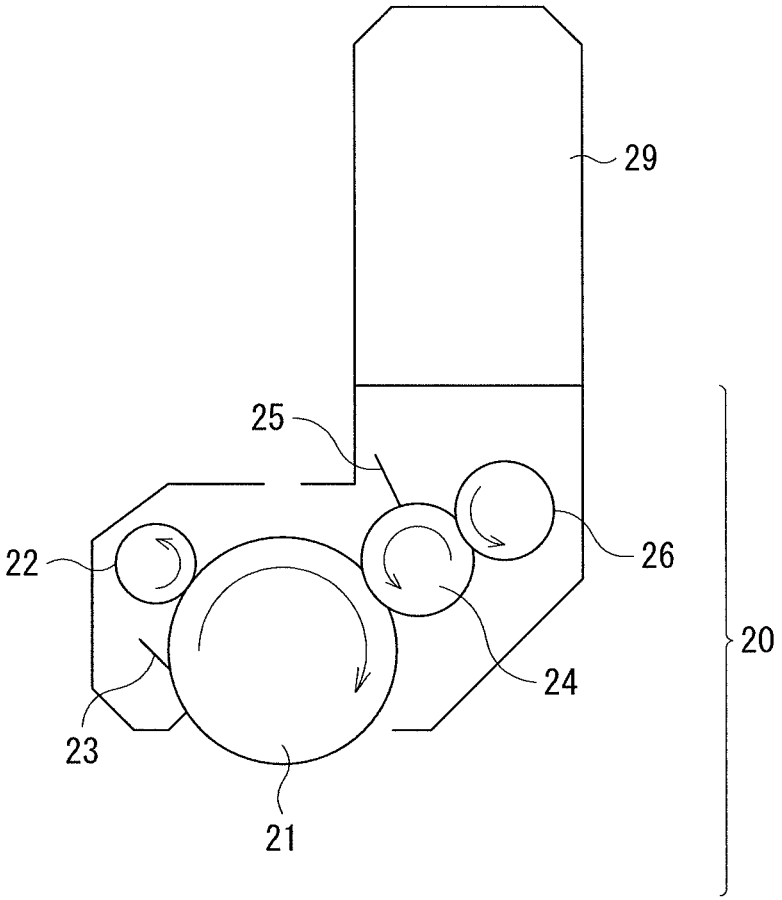
FIG. 2 illustrates an example of a configuration of a developing section illustrated in FIG. 1.

FIG. 2 illustrates an example of a configuration of any of the developing sections 20. It is to be noted that FIG. 2 depicts any of the toner containers 29 in addition to its corresponding developing section 20. The developing sections 20 each may include a photosensitive drum 21, a charging roller 22, a cleaning blade 23, a developing roller 24, a development blade 25, and a feeding roller 26.

The photosensitive drum 21 may be a member that supports an electrostatic latent image on a surface (a superficial part) of the photosensitive drum 21, and may include a photoreceptor. The photosensitive drum 21 may be rotated clockwise in the example embodiment by means of drive power transmitted from a drum motor 20T to be described later. The photosensitive drum 21 may be charged by the corresponding charging roller 22. The photosensitive drum 21 of the developing section 20C may be subjected to exposure by the exposure head 16C, and the photosensitive drum 21 of the developing section 20M may be subjected to exposure by the exposure head 16M. The photosensitive drum 21 of the developing section 20Y may be subjected to exposure by the exposure head 16Y, and the photosensitive drum 21 of the developing section 20K may be subjected to exposure by the exposure head 16K. In this way, the electrostatic latent images may be formed on the surfaces of the respective photosensitive drums 21.

The charging roller 22 may be a member that charges the surface (the superficial part) of the photosensitive drum 21. The charging roller 22 may be so disposed as to be in contact with the surface (a circumferential surface) of the photosensitive drum 21, and as to be pressed against the photosensitive drum 21 by a predetermined pressing amount. In the example embodiment, the charging roller 22 may be rotated counterclockwise in response to the rotation of the photosensitive drum 21. A charging voltage may be applied to the charging roller 22 by a high-voltage power supply section 55 to be described later.

The cleaning blade 23 may be a member that scrapes the toner remaining on the surface (the superficial part) of the photosensitive drum 21 to clean the surface of the photosensitive drum 21. The cleaning blade 23 may be so disposed to counter-face the photosensitive drum 21 as to come into contact with the surface of the photosensitive drum 21, i.e., protrude in a direction opposite to the direction of the rotation of the photosensitive drum 21, and as to be pressed against the photosensitive drum 21 by a predetermined pressing amount.

The developing roller 24 may be a member that supports the toner on a surface of the developing roller 24. The developing roller 24 may be so disposed as to be in contact with the surface (the circumferential surface) of the photosensitive drum 21, and as to be pressed against the photosensitive drum 21 by a predetermined pressing amount. In the example embodiment, the developing roller 24 may be rotated counterclockwise by means of drive power transmitted from the drum motor 20T to be described later. On each of the photosensitive drums 21, the toner image corresponding to the electrostatic latent image may be formed or "developed" by the toner fed from the developing roller 24. A development voltage may be applied to the developing roller 24 by the high-voltage power supply section 55 to be described later.

The development blade 25 may be a member that comes into contact with the surface of the developing roller 24 to thereby form a layer made of the toner (i.e., a toner layer) on the surface of the developing roller 24 and regulate (control or adjust) a thickness of the toner layer. The development blade 25 may be a plate-shaped elastic member bent into an "L" shape. The plate-shaped elastic member may be made of, for example but not limited to, a stainless steel. The development blade 25 may be so disposed that a bent part of the development blade 25 comes into contact with the surface of the developing roller 24, and as to be pressed against the developing roller 24 by a predetermined pressing amount. A supply voltage may be applied to the development blade 25 by the high-voltage power supply section 55 to be described later.

The feeding roller 26 may be a member that feeds the toner stored in the toner container 29 to the developing roller 24. The feeding roller 26 may be so disposed as to be in contact with the surface (a circumferential surface) of the developing roller 24, and as to be pressed against the developing roller 24 by a predetermined pressing amount. In the example embodiment, the feeding roller 26 may be rotated counterclockwise by means of the drive power transmitted from the drum motor 20T to be described later. This causes a friction between a surface of the feeding roller 26 and the surface of the developing roller 24 in each of the developing sections 20, which in turn makes possible to electrically charge the toner by means of a so-called frictional electrification in each of the developing sections 20. The supply voltage may be applied to the feeding roller 26 by the high-voltage power supply section 55 to be described later.

Referring to FIG. 1, the exposure head 16C may be a member that irradiates the photosensitive drum 21 of the developing section 20C with light, and the exposure head 16M may be a member that irradiates the photosensitive drum 21 of the developing section 20M with light. The exposure head 16Y may be a member that irradiates the photosensitive drum 21 of the developing section 20Y with light, and the exposure head 16K may be a member that irradiates the photosensitive drum 21 of the developing section 20K with light. This causes the photosensitive drums 21 to be subjected to exposure by their respective exposure heads 16C, 16M, 16Y, and 16K, which in turn forms the electrostatic latent images on the surfaces of the respective photosensitive drums 21.

The transfer section 30 may be a member that transfers the toner images formed by the four developing sections 20C, 20M, 20Y, and 20K onto a transfer surface of the recording medium 9. The transfer section 30 may include transfer rollers 31C, 31M, 31Y, and 31K, a transfer belt 32, a drive roller 33, and a driven roller 34.

The transfer roller 31C may be disposed to face the photosensitive drum 21 of the developing section 20C with the conveying path 10 interposed in between, and the transfer roller 31M may be disposed to face the photosensitive drum 21 of the developing section 20M with the conveying path 10 interposed in between. The transfer roller 31Y may be disposed to face the photosensitive drum 21 of the developing section 20Y with the conveying path 10 interposed in between, and the transfer roller 31K may be disposed to face the photosensitive drum 21 of the developing section 20K with the conveying path 10 interposed in between. A transfer voltage may be applied to each of the transfer rollers 31C, 31M, 31Y, and 31K by the high-voltage power supply section 55 to be described later.

The transfer belt 32 may convey the recording medium 9 along the conveying path 10. The transfer belt 32 may be stretched by and stretched around the drive roller 33 and the driven roller 34. The transfer belt 32 may be rotated and thereby circulate in a direction toward the conveying direction F in response to rotation of the drive roller 33. Upon the circulation, the transfer belt 32 may travel through regions between the developing section 20C and the transfer roller 31C, between the developing section 20M and the transfer roller 31M, between the developing section 20Y and the transfer roller 31Y, and between the developing section 20K and the transfer roller 31K.

The drive roller 33 may cause the transfer belt 32 to be rotated and thereby circulate. In the example embodiment, the drive roller 33 may be disposed downstream of the four developing sections 20 in the conveying direction F, and rotated counterclockwise by means of drive power transmitted from a belt motor 33T to be described later, making it possible for the drive roller 33 to cause the transfer belt 32 to circulate in the direction toward the conveying direction F.

The driven roller 34 may be driven to rotate counterclockwise in the example embodiment, in response to the rotation and circulation of the transfer belt 32. The driven roller 34 may be disposed upstream of the four developing sections 20 in the conveying direction F in the example embodiment.

The cleaning blade 14 may be a member that scrapes the toner remaining on a transfer surface of the transfer belt 32 to clean the transfer surface of the transfer belt 32. The scraped toner may be stored in a cleaner container 15.

The fixing section 40 may be a member that applies heat and pressure to the recording medium 9 to thereby fix, to the recording medium 9, the toner images having been transferred onto the recording medium 9. The fixing section 40 may include a heat roller 41, a pressure-applying roller 43, and a thermistor 44. The heat roller 41 may be a member provided therein with two heaters 42A and 42B, and that applies the heat to the toner on the recording medium 9. The heaters 42A and 42B each may be, for example but not limited to, a halogen heater, a ceramic heater, or any other suitable heating device. The pressure-applying roller 43 may be a member so disposed as to form a pressurized region between the pressure-applying roller 43 and the heat roller 41, and that applies the pressure to the toner on the recording medium 9. The heat roller 41 and the pressure-applying roller 43 each may be rotated by means of drive power transmitted from a heater motor 40T to be described later. The thermistor 44 may detect a temperature of the fixing section 40. With this configuration, the toner on the recording medium 9 may be heated, melted, and pressurized in the fixing section 40, making it possible to fix the toner images to the recording medium 9.

In the image forming apparatus 1, printing may be performed in this way on the recording medium 9. The recording medium 9 having been subjected to the printing may be conveyed along the conveying path 10 by a medium guide 17 and stacked on a discharge tray 18.

Control Mechanism of Image Forming Apparatus 1

Figure 3:
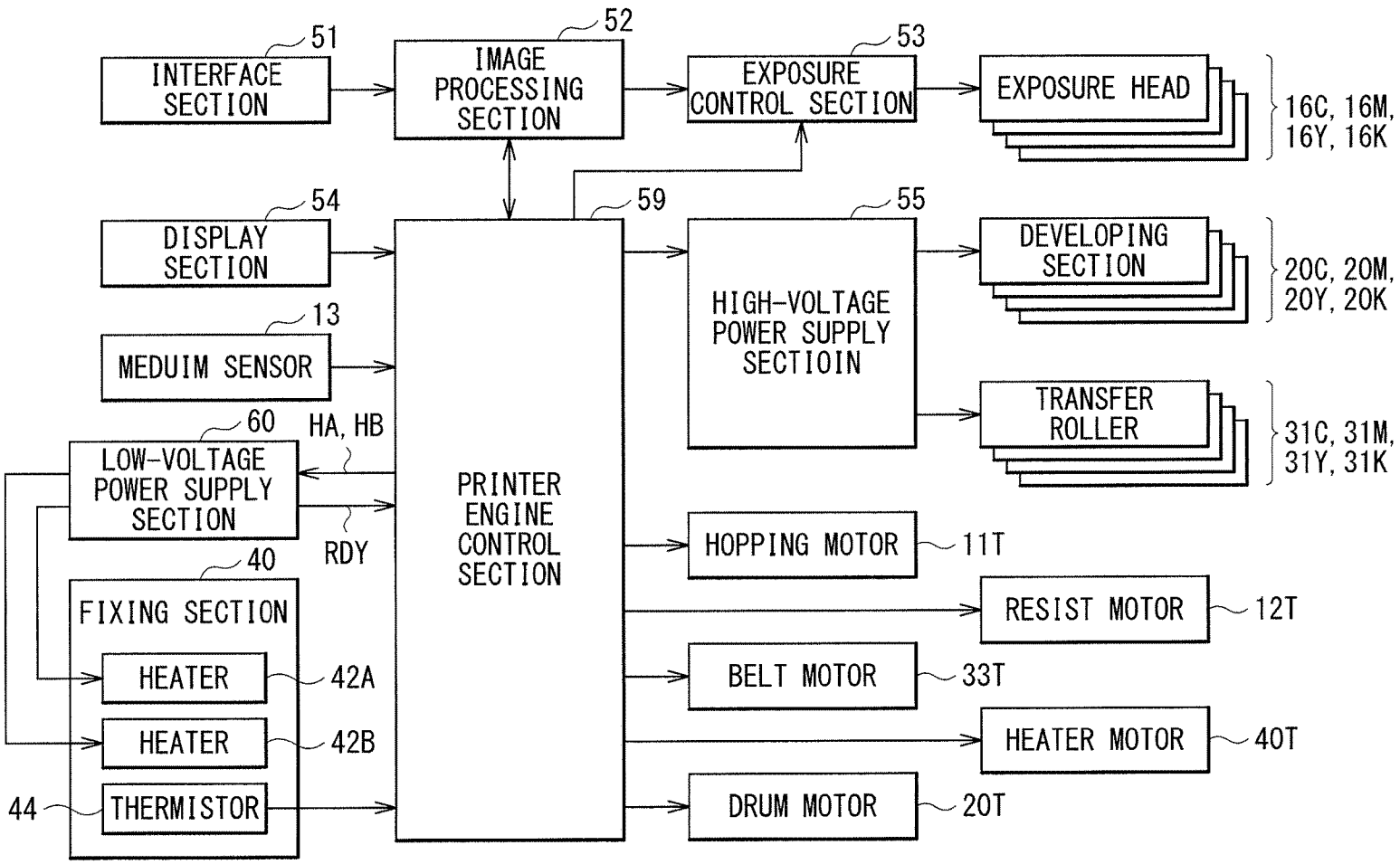
FIG. 3 is a block diagram illustrating an example of a control mechanism in the image forming apparatus illustrated in FIG. 1.

FIG. 3 illustrates an example of a control mechanism in the image forming apparatus 1. The image forming apparatus 1 may include an interface section 51, an image processing section 52, an exposure control section 53, a display section 54, the high-voltage power supply section 55, a low-voltage power supply section 60, and a printer engine control section 59.

The interface section 51 may receive printing data from, for example but not limited to, an unillustrated host computer. The printing data may be described in, for example but not limited to, Page Description Language (PDL). The interface section 51 may also exchange various control signals between the interface section 51 and the host computer.

The image processing section 52 may notify the printer engine control section 59 of the reception of the printing data. The image processing section 52 may also perform, in response to instructions given from the printer engine control section 59, a predetermined process on the basis of the printing data supplied from the interface section 51 to thereby generate bitmap data.

The exposure control section 53 may control an operation of each of the exposure heads 16C, 16M, 16Y, and 16K, based on the instructions given from the printer engine control section 59 and on the bitmap data supplied from the image processing section 52.

The display section 54 may display information such as, but not limited to, a state of operation of the image forming apparatus 1. The display section 54 may be, for example but not limited to, a liquid crystal display.

The high-voltage power supply section 55 may generate, based on the instructions given from the printer engine control section 59, the charge voltages to be applied to the charging rollers 22 of the respective developing sections 20C, 20M, 20Y, and 20K, the development voltages to be applied to the developing rollers 24 of the respective developing sections 20C, 20M, 20Y, and 20K, the supply voltages to be applied to the feeding rollers 26 of the respective developing sections 20C, 20M, 20Y, and 20K, and the transfer voltages to be applied to the respective transfer rollers 31C, 31M, 31Y, and 31K.

The low-voltage power supply section 60 may supply the heaters 42A and 42B of the fixing section 40 with electric power, based on the instructions given from the printer engine control section 59. A description of the low-voltage power supply section 60 will be given later in greater detail.

The printer engine control section 59 may control each block provided in the image forming apparatus 1. In one specific but non-limiting example, the printer engine control section 59 may control the image processing section 52 to generate the bitmap data, based on the printing data. Further, the printer engine control section 59 may control the low-voltage power supply section 60 to cause the low-voltage power supply section 60 to supply the electric power to the heaters 42A and 42B in the fixing section 40, and may adjust the electric power to be supplied to the heaters 42A and 42B, based on a result of the detection obtained from the thermistor 44. The printer engine control section 59 may control the hopping motor 11T to rotate the hopping roller 11, may control the resist motor 12T to rotate the resist roller 12, may control the drum motor 20T to rotate the photosensitive drum 21, the developing roller 24, and the feeding roller 26 provided in each of the developing sections 20C, 20M, 20Y, and 20K, may control the belt motor 33T to rotate the drive roller 33, and may control the heater motor 40T to rotate the heat roller 41 and the pressure-applying roller 43. The printer engine control section 59 may control the high-voltage power supply section 55 to generate the various voltages, based on a result of the detection obtained from the medium sensor 13. The printer engine control section 59 may control an operation of the exposure control section 53 to operate each of the exposure heads 16C, 16M, 16Y, and 16K. The printer engine control section 59 may also control the display section 54 to display the state of the operation of the image forming apparatus 1 or any other information.

The printer engine control section 59 may, upon controlling the low-voltage power supply section 60, supply the low-voltage power supply section 60 with heater control signals HA and HB, and receive a ready signal RDY from the low-voltage power supply section 60. The heater control signal HA may be directed to instructions on electric power supply to the heater 42A. The heater control signal HB may be directed to instructions on electric power supply to the heater 42B. The ready signal RDY may be directed to notifications that the low-voltage power supply section 60 is ready to supply the heaters 42A and 42B with electric power.

Low-Voltage Power Supply Section 60

Figure 4:
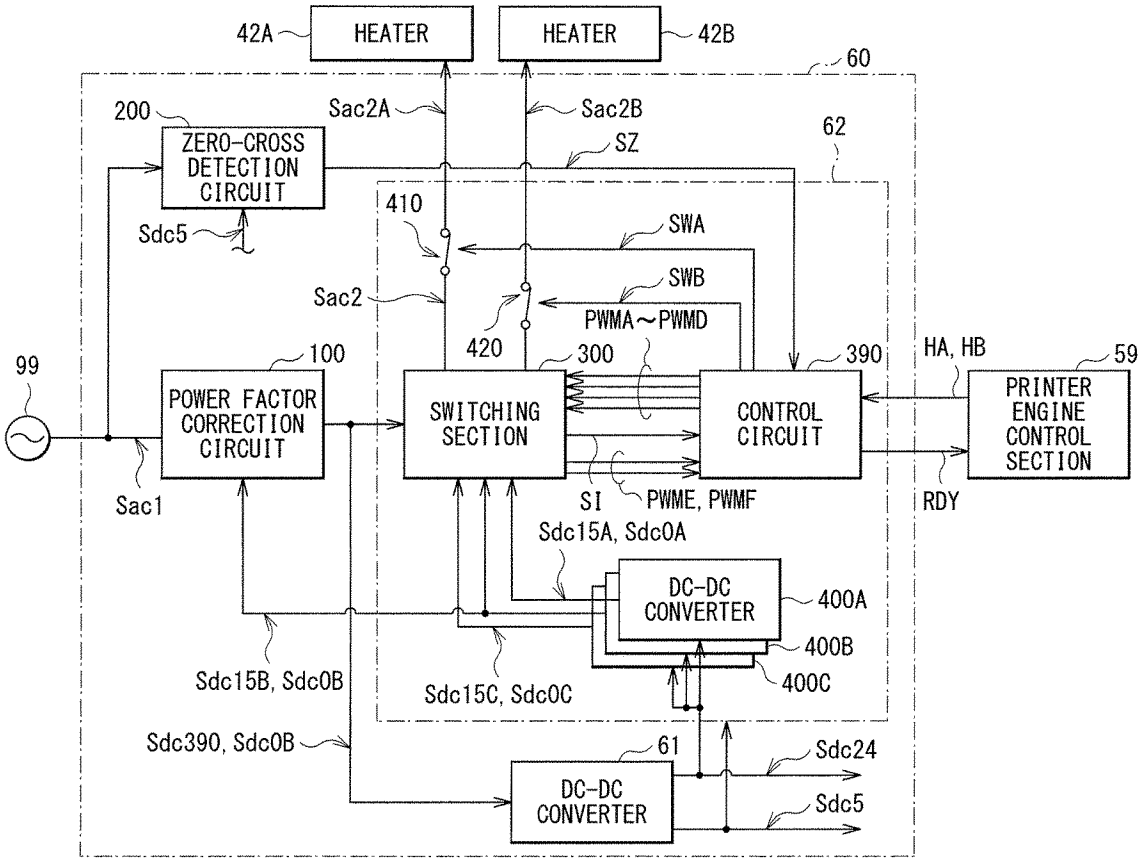
FIG. 4 is a block diagram illustrating an example of a configuration of a low-voltage power supply section illustrated in FIG. 3.

FIG. 4 illustrates an example of a configuration of the low-voltage power supply section 60. FIG. 4 also depicts a commercial power supply 99, the heaters 42A and 42B, and the printer engine control section 59, in addition to the low-voltage power supply section 60. The low-voltage power supply section 60 may generate, based on an alternating-current signal Sac1 supplied from the commercial power supply 99, alternating-current signals Sac2A and Sac2B. The low-voltage power supply section 60 may supply the generated alternating-current signal Sac2A to the heater 42A, and supply the generated alternating-current signal Sac2B to the heater 42B. In this example embodiment, a frequency and an effective value of the alternating-current signal Sac1 supplied from the commercial power supply 99 may respectively be 50 Hz and 100 Vrms. It is to be noted that the frequency and the effective value of the alternating-current signal Sac1 are not limited thereto; the frequency may be, for example but not limited to, 60 Hz, and the effective value may be, for example but not limited to, any value within a range from 80 Vrms to 260 Vrms both inclusive. The low-voltage power supply section 60 may include a power factor correction circuit 100, a zero-cross detection circuit 200, a DC-DC converter 61, and a DC-AC inverter 62.

Power Factor Correction Circuit 100

The power factor correction circuit 100 may generate a signal Sdc390, based on the alternating-current signal Sac1.

In this example embodiment, the signal Sdc390 may have a voltage of 390 V. It is to be noted that the voltage thereof is not limited thereto; the signal Sdc390 may have any voltage other than 390 V. In the following, a description is given in detail of the power factor correction circuit 100.

Figure 5:
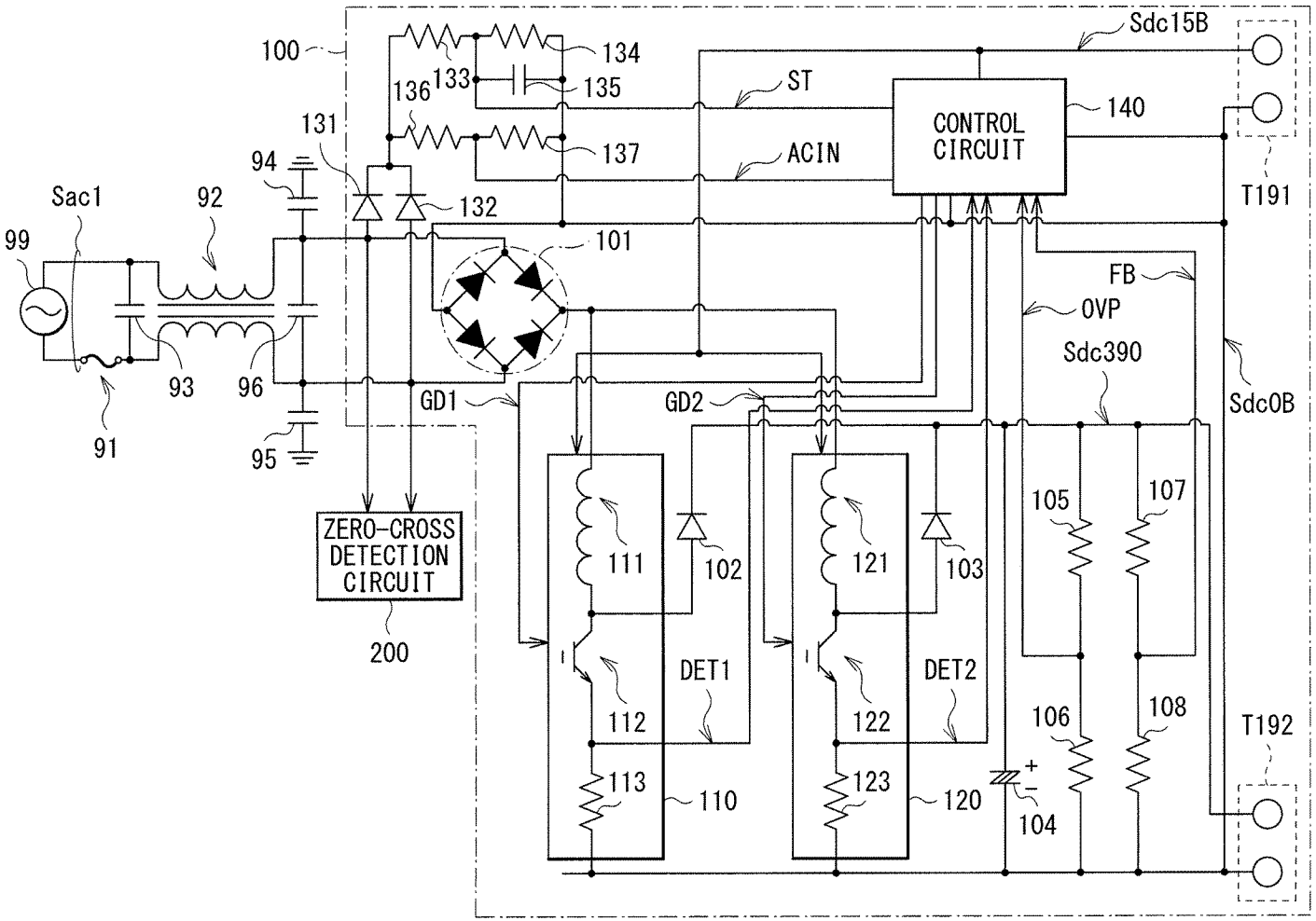
FIG. 5 is a circuit diagram illustrating an example of a configuration of a power factor correction circuit illustrated in FIG. 4.

FIG. 5 illustrates an example of a configuration of the power factor correction circuit 100. The power factor correction circuit 100 may be coupled to the commercial power supply 99 through a fuse 91 and a common mode coil 92. In one specific but non-limiting example, the commercial power supply 99 may have a first end coupled to a first end of a capacitor 93 and a first end of a first winding of the common mode coil 92, and a second end coupled to a first end of the fuse 91. The fuse 91 may have the first end coupled to the second end of the commercial power supply 99, and a second end coupled to a second end of the capacitor 93 and a first end of a second winding of the common mode coil 92. The capacitor 93 may be a so-called an across-the-line capacitor (an X capacitor), and may have the first end coupled to the first end of the commercial power supply 99 and the first end of the first winding of the common mode coil 92, and the second end coupled to the second end of the fuse 91 and the first end of the second winding of the common mode coil 92. The common mode coil 92 may include the first winding that has the first end coupled to the first end of the commercial power supply 99 and the first end of the capacitor 93, and that has a second end coupled to a first end of a capacitor 94, a first end of a capacitor 96, the power factor correction circuit 100, and the zero-cross detection circuit 200. The common mode coil 92 may include the second winding that has the first end coupled to the second end of the fuse 91 and the second end of the capacitor 93, and that has a second end coupled to a first end of a capacitor 95, a second end of the capacitor 96, the power factor correction circuit 100, and the zero-cross detection circuit 200. The capacitors 94 and 95 may be so-called line-bypass-capacitors (Y capacitors). The capacitor 94 may have the first end coupled to the second end of the first winding of the common mode coil 92 and the first end of the capacitor 96, and a second end that may be grounded. The capacitor 95 may have the first end coupled to the second end of the second winding of the common mode coil 92 and the second end of the capacitor 96, and a second end that may be grounded. The capacitor 96 may be a so-called across-the-line capacitor (an X capacitor), and may have the first end coupled to the second end of the first winding of the common mode coil 92 and the first end of the capacitor 94, and the second end coupled to the second end of the second winding of the common mode coil 92 and the first end of the capacitor 95. The common mode coil 92 and the capacitors 93 to 96 may constitute a so-called common mode filter.

The power factor correction circuit 100 may include a bridge diode 101, switching circuits 110 and 120, diodes 102 and 103, an electrolytic capacitor 104, resistors 105 to 108, diodes 131 and 132, resistors 133 and 134, a capacitor 135, resistors 136 and 137, and a control circuit 140. The power factor correction circuit 100 may receive signals Sdc15B and Sdc0B from a later-described DC-DC converter 400B through a terminal T191. The signal Sdc15B may have a voltage higher than a voltage of the signal Sdc0B by 15 V without limitation. The power factor correction circuit 100 may output the signals Sdc390 and Sdc0B through a terminal T192.

The bridge diode 101 may perform a full-wave rectification on an alternating-current signal outputted from the common mode coil 92. A cathode of a first diode and an anode of a second diode of the bridge diode 101 may be coupled to the second end of the first winding of the common mode coil 92, whereas a cathode of a third diode and an anode of a fourth diode of the bridge diode 101 may be coupled to the second end of the second winding of the common mode coil 92. An anode of the first diode and an anode of the third diode of the bridge diode 101 each may receive the signal Sdc0B. A cathode of the second diode and a cathode of the fourth diode of the bridge diode 101 each may be coupled to the switching circuits 110 and 120.

The switching circuit 110 may perform a switching operation, based on a gate drive signal GD1.

Figure 6:
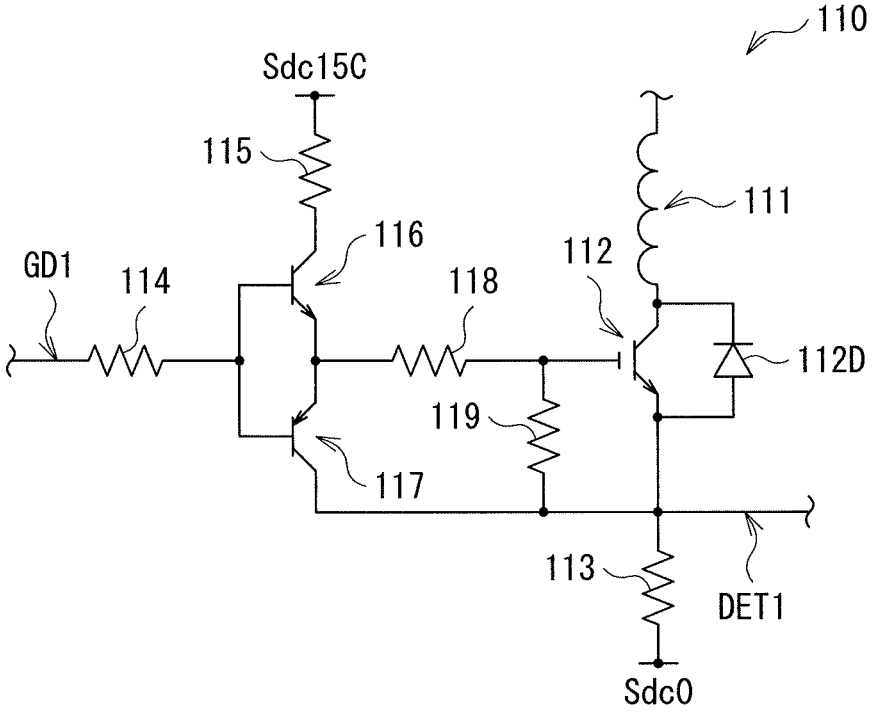
FIG. 6 is a circuit diagram illustrating an example of a configuration of a switching circuit illustrated in FIG. 5.

FIG. 6 illustrates an example of a configuration of the switching circuit 110. The switching circuit 110 may include resistors 114 and 115, a NPN transistor 116, a PNP transistor 117, resistors 118 and 119, an inductor 111, an IGBT (Insulated Gate Bipolar Transistor) 112, a diode 112D, and a resistor 113. It is to be noted that FIG. 5 depicts the inductor 111, the IGBT 112, and the resistor 113 among the elements mentioned above.

The resistor 114 may have a first end that receives the gate drive signal GD1, and a second end coupled to a base of the NPN transistor 116 and a base of the PNP transistor 117. The resistor 115 may have a first end that receives the signal Sdc15B, and a second end coupled to a collector of the NPN transistor 116. The NPN transistor 116 may have the collector coupled to the second end of the resistor 115, the base coupled to the second end of the resistor 114 and the base of the PNP transistor 117, and an emitter coupled to an emitter of the PNP transistor 117 and a first end of the resistor 118. The PNP transistor 117 may have the emitter coupled to the emitter of the NPN transistor 116 and the first end of the resistor 118, the base coupled to the second end of the resistor 114 and the base of the NPN transistor 116, and a collector coupled to a second end of the resistor 119, an emitter of the IGBT 112, an anode of the diode 112D, and a first end of the resistor 113. The resistor 118 may have the first end coupled to the emitter of the NPN transistor 116 and the emitter of the PNP transistor 117, and a second end coupled to a first end of the resistor 119 and a base of the IGBT 112. The resistor 119 may have the first end coupled to the second end of the resistor 118 and the base of the IGBT 112, and the second end coupled to the collector of the PNP transistor 117, the emitter of the IGBT 112, the anode of the diode 112D, and the first end of the resistor 113. The inductor 111 may have a first end coupled to the cathode of the second diode and the cathode of the fourth diode of the bridge diode 101 as illustrated in FIG. 5, and a second end coupled to a collector of the IGBT 112 and a cathode of the diode 112D. The IGBT 112 may have the collector coupled to the second end of the inductor 111 and the cathode of the diode 112D, the base coupled to the second end of the resistor 118 and the first end of the resistor 119, and the emitter coupled to the collector of the PNP transistor 117, the second end of the resistor 119, the anode of the diode 112D, and the first end of the resistor 113. The diode 112D may have the anode coupled to the emitter of the IGBT 112, the collector of the PNP transistor 117, the second end of the resistor 119, and the first end of the resistor 113, and the cathode coupled to the second end of the inductor 111 and the collector of the IGBT 112. The resistor 113 may have the first end coupled to the collector of the PNP transistor 117, the second end of the resistor 119, the emitter of the IGBT 112, and the anode of the diode 112D, and a second end that receives the signal Sdc0B. A voltage at the first end of the resistor 113 may be supplied as a signal DET1 to the control circuit 140.

The switching circuit 120 as illustrated in FIG. 5 may perform a switching operation, based on a gate drive signal GD2. The switching circuit 120 may have a configuration similar to the configuration of the switching circuit 110 illustrated in FIG. 6. The switching circuit 120 may include an inductor 121, an IGBT 122, and a resistor 123. The inductor 121, the IGBT 122, and the resistor 123 may respectively correspond to the inductor 111, the IGBT 112, and the resistor 113 in the switching circuit 110. A voltage at a first end of the resistor 123 may be supplied as a signal DET2 to the control circuit 140.

In this example embodiment, the IGBTs 112 and 122 are used. However, this is illustrative and non-limiting. Instead, for example, a SiC-FET and a GaN-FET may be used.

The diode 102 may have an anode coupled to the second end of the inductor 111 and any other element, and a cathode coupled to a cathode of the diode 103, a positive terminal of the electrolytic capacitor 104, a first end of the resistor 105, and a first end of the resistor 107. The diode 103 may have an anode coupled to a second end of the inductor 121 and any other element, and the cathode coupled to the cathode of the diode 102, the positive terminal of the electrolytic capacitor 104, the first end of the resistor 105, and the first end of the resistor 107. The electrolytic capacitor 104 may have the positive terminal coupled to the cathode of the diode 102, the cathode of the diode 103, the first end of the resistor 105, and the first end of the resistor 107, and a negative terminal that receives the signal Sdc0B. A voltage at the positive terminal of the electrolytic capacitor 104 may be outputted as the signal Sdc390 through the terminal T192.

The resistor 105 may have the first end coupled to the cathode of the diode 102, the cathode of the diode 103, the positive terminal of the electrolytic capacitor 104, and the first end of the resistor 107, and a second end coupled to a first end of the resistor 106. The resistor 106 may have the first end coupled to the second end of the resistor 105, and a second end that receives the signal Sdc0B. A voltage at the second end of the resistor 105 and at the first end of the resistor 106 may be supplied as a signal OVP to the control circuit 140.

The resistor 107 may have the first end coupled to the cathode of the diode 102, the cathode of the diode 103, the positive terminal of the electrolytic capacitor 104, and the first end of the resistor 105, and a second end coupled to a first end of the resistor 108. The resistor 108 may have the first end coupled to the second end of the resistor 107, and a second end that receives the signal Sdc0B. A voltage at the second end of the resistor 107 and at the first end of the resistor 108 may be supplied as a signal FB to the control circuit 140.

The diodes 131 and 132 may form a circuit that performs a full-wave rectification on the alternating-current signal outputted from the common mode coil 92. The diode 131 may have an anode coupled to the second end of the first winding of the common mode choke coil 92, and a cathode coupled to a cathode of the diode 132, a first end of the resistor 133, and a first end of the resistor 136. The diode 132 may have an anode coupled to the second end of the second winding of the common mode coil 92, and the cathode coupled to the cathode of the diode 131, the first end of the resistor 133, and the first end of the resistor 136.

The resistor 133 may have the first end coupled to the cathode of the diode 131, the cathode of the diode 132, and the first end of the resistor 136, and a second end coupled to a first end of the resistor 134 and a first end of the capacitor 135. The resistor 134 may have the first end coupled to the second end of the resistor 133 and the first end of the capacitor 135, and a second end that receives the signal Sdc0B. The capacitor 135 may have the first end coupled to the second end of the resistor 133 and the first end of the resistor 134, and a second end that receives the signal Sdc0B. A voltage at the second end of the resistor 133, at the first end of the resistor 134, and at the first end of the capacitor 135 may be supplied as a signal ST to the control circuit 140.

The resistor 136 may have the first end coupled to the cathode of the diode 131, the cathode of the diode 132, and the first end of the resistor 133, and a second end coupled to a first end of the resistor 137. The resistor 137 may have the first end coupled to the second end of the resistor 136, and a second end that receives the signal Sdc0B. A voltage at the second end of the resistor 136 and at the first end of the resistor 137 may be supplied as a signal ACIN to the control circuit 140.

The control circuit 140 may supply the switching circuit 110 and the switching circuit 120 with the gate drive signal GD1 and the gate drive signal GD2, respectively, to so control the power factor correction circuit 100 as to generate the signal Sdc390. In one specific but non-limiting example, the control circuit 140 may vary, based on the signal FB, a switching duty ratio of each of the gate drive signals GD1 and GD2 to so control the voltage of the signal Sdc390 as to be a desired voltage (which can be 390 V in this example embodiment although it is not limited thereto). The control circuit 140 may also so control, based on the signal OVP, the voltage of the signal Sdc390 as to prevent the voltage of the signal Sdc390 from being excessive. Upon controlling the power factor correction circuit 100, the control circuit 140 may so control, based on the signal ACIN, the switching operation performed by each of the switching circuits 110 and 120 as to allow a power factor to be close to 1 (one), e.g., to be 0.9 or greater without limitation.

The control circuit 140 may also have a function to monitor, based on the signal DET1, whether or not an excessive current flows to the IGBT 112, and monitor, based on the signal DET2, whether or not an excessive current flows to the IGBT 122. The control circuit 140 may stop the switching operation of each of the switching circuits 110 and 120 upon the presence of flow of the excessive current. Further, the control circuit 140 may allow, based on the signal ST, the switching circuits 110 and 120 to perform their switching operations in a case with an amplitude of the alternating-current signal Sac1 being equal to or greater than a predetermined amplitude.

Zero-Cross Detection Circuit 200

The zero-cross detection circuit 200 as illustrated in FIG. 4 may generate a zero-cross signal SZ, based on the alternating-current signal Sac1. In the following, a description is given in detail of the zero-cross detection circuit 200.

Figure 7:
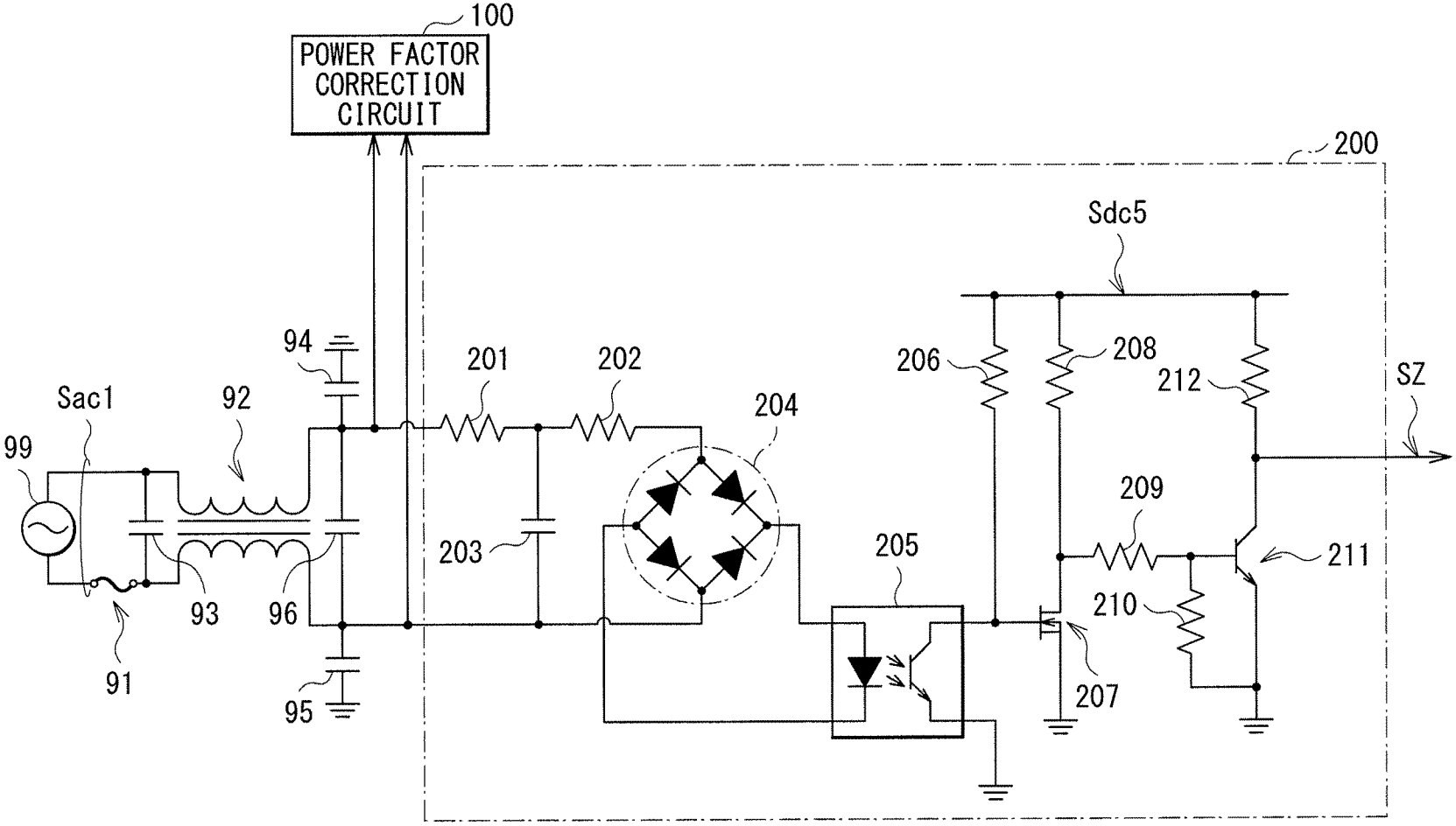
FIG. 7 is a circuit diagram illustrating an example of a configuration of a zero-cross detection circuit illustrated in FIG. 4.

FIG. 7 illustrates an example of a configuration of the zero-cross detection circuit 200. As with the power factor correction circuit 100, the zero-cross detection circuit 200 may be coupled to the commercial power supply 99 through the fuse 91 and the common mode coil 92.

The zero-cross detection circuit 200 may include resistors 201 and 202, a capacitor 203, a bridge diode 204, a photo coupler 205, a resistor 206, an N-channel FET (Field-Effect Transistor) 207, resistors 208 to 210, an NPN transistor 211, and a resistor 212. The zero-cross detection circuit 200 may receive a signal Sdc5 from the DC-DC converter 61. The signal Sdc5 may have a voltage of 5 V in this example embodiment without limitation.

The resistor 201 may have a first end coupled to the second end of the first winding of the common mode coil 92, and a second end coupled to a first end of the resistor 202 and a first end of the capacitor 203. The resistor 202 may have the first end coupled to the second end of the resistor 201 and the first end of the capacitor 203, and a second end coupled to a cathode of a first diode and an anode of a second diode of the bridge diode 204. The capacitor 203 may have the first end coupled to the second end of the resistor 201 and the first end of the resistor 202, and a second end coupled to the second end of the second winding of the common mode coil 92 and a cathode of a third diode and an anode of a fourth diode of the bridge diode 204.

The bridge diode 204 may perform a full-wave rectification on a signal between the second end of the resistor 202 and the second end of the capacitor 203. The cathode of the first diode and the anode of the second diode of the bridge diode 204 may be coupled to the second end of the resistor 202, whereas the cathode of the third diode and the anode of the fourth diode of the bridge diode 204 may be coupled to the second end of the capacitor 203. An anode of the first diode and an anode of the third diode of the bridge diode 204 may be coupled to a cathode of a light-emitting diode of the photo coupler 205. A cathode of the second diode and a cathode of the fourth diode of the bridge diode 204 may be coupled to an anode of the light-emitting diode of the photo coupler 205.

The anode of the light-emitting diode of the photo coupler 205 may be coupled to the cathode of the second diode and the cathode of the fourth diode of the bridge diode 204, whereas the cathode of the light-emitting diode may be coupled to the anode of the first diode and the anode of the third diode of the bridge diode 204. An emitter of a photo diode of the photo coupler 205 may be grounded, and a collector of the photo diode may be coupled to a second end of the resistor 206 and a gate of the N-channel FET 207.

The resistor 206 may have a first end that receives the signal Sdc5, and the second end coupled to the collector of the photo diode of the photo coupler 205 and the gate of the N-channel FET 207. The N-channel FET 207 may have a drain coupled to a second end of the resistor 208 and a first end of the resistor 209, the gate coupled to the collector of the photo diode of the photo coupler 205 and the second end of the resistor 206, and a source that may be grounded. The resistor 208 may have a first end that receives the signal Sdc5, and the second end coupled to the drain of the N-channel FET 207 and the first end of the resistor 209. The resistor 209 may have the first end coupled to the drain of the N-channel FET 207 and the second end of the resistor 208, and a second end coupled to a base of the NPN transistor 211 and a first end of the resistor 210. The resistor 210 may have the first end coupled to the second end of the resistor 209 and the base of the NPN transistor 211, and a second end that may be grounded. The NPN transistor 211 may have a collector coupled to a second end of the resistor 212, the base coupled to the second end of the resistor 209 and the first end of the resistor 210, and an emitter that may be grounded. The resistor 212 may have a first end that receives the signal Sdc5, and the second end coupled to the collector of the NPN transistor 211. The zero-cross detection circuit 200 may output, as a zero-cross signal SZ, a voltage at the collector of the NPN transistor 211 and at the second end of the resistor 212.

With this configuration, the zero-cross detection circuit 200 may generate the zero-cross signal SZ. The zero-cross signal SZ may have pulses generated for each of zero-cross timings of the alternating-current signal Sac1.

DC-DC Converter 61

The DC-DC converter 61 as illustrated in FIG. 4 may generate a signal Sdc24 and the signal Sdc5, based on the signal Sdc390. The signal Sdc24 may have a voltage of 24 V in this example embodiment without limitation. The signals Sdc24 and Sdc5 may be used in various blocks provided in the image forming apparatus 1. The DC-DC converter 61 may have a configuration that utilizes a known technology.

DC-AC Inverter 62

The DC-AC inverter 62 may generate the alternating-current signal Sac2A and Sac2B, based on the signal Sdc390, the zero-cross signal SZ, and the heater control signals HA and HB. In one specific but non-limiting example, the DC-AC inverter 62 may generate, based on the zero-cross signal SZ, the alternating-current signal Sac2 that may have a frequency substantially equal to the frequency of the alternating-current signal Sac1, as described later. The DC-AC inverter 62 may supply, based on the heater control signal HA, the alternating-current signal Sac2, as the alternating-current signal Sac2A, to the heater 42A, and may supply, based on the heater control signal HB, the alternating-current signal Sac2, as the alternating-current signal Sac2B, to the heater 42B. Moreover, the DC-AC inverter 62 may perform a so-called slow-up control at start of electric power supply to the heaters 42A and 42B, allowing for a gradual increase in an amount of the electric power supply. The DC-AC inverter 62 may include DC-DC converters 400A, 400B, and 400C, a switching section 300, AC switches 410 and 420, and a control circuit 390.

The DC-DC converter 400A may generate a signal Sdc15A and a signal Sdc0A, based on the signal Sdc24. The DC-DC converter 400B may generate the signal Sdc15B and the signal Sdc0B, based on the signal Sdc24. The DC-DC converter 400C may generate a signal Sdc15C and a signal Sdc0C, based on the signal Sdc24. The signal Sdc15A may have a voltage higher than a voltage of the signal Sdc0A by 15 V without limitation. The signal Sdc15C may have a voltage higher than a voltage of the signal Sdc0C by 15 V without limitation.

The switching section 300 may generate the alternating-current signal Sac2, based on the signal Sdc390 and PWM signals PWMA, PWMB, PWMC, and PWMD. The switching section 300 may also have a function of notifying the control circuit 390 of information on an input current, an input voltage, and an output voltage, with use of a signal SI and PWM signals PWME and PWMF.

Figure 8:
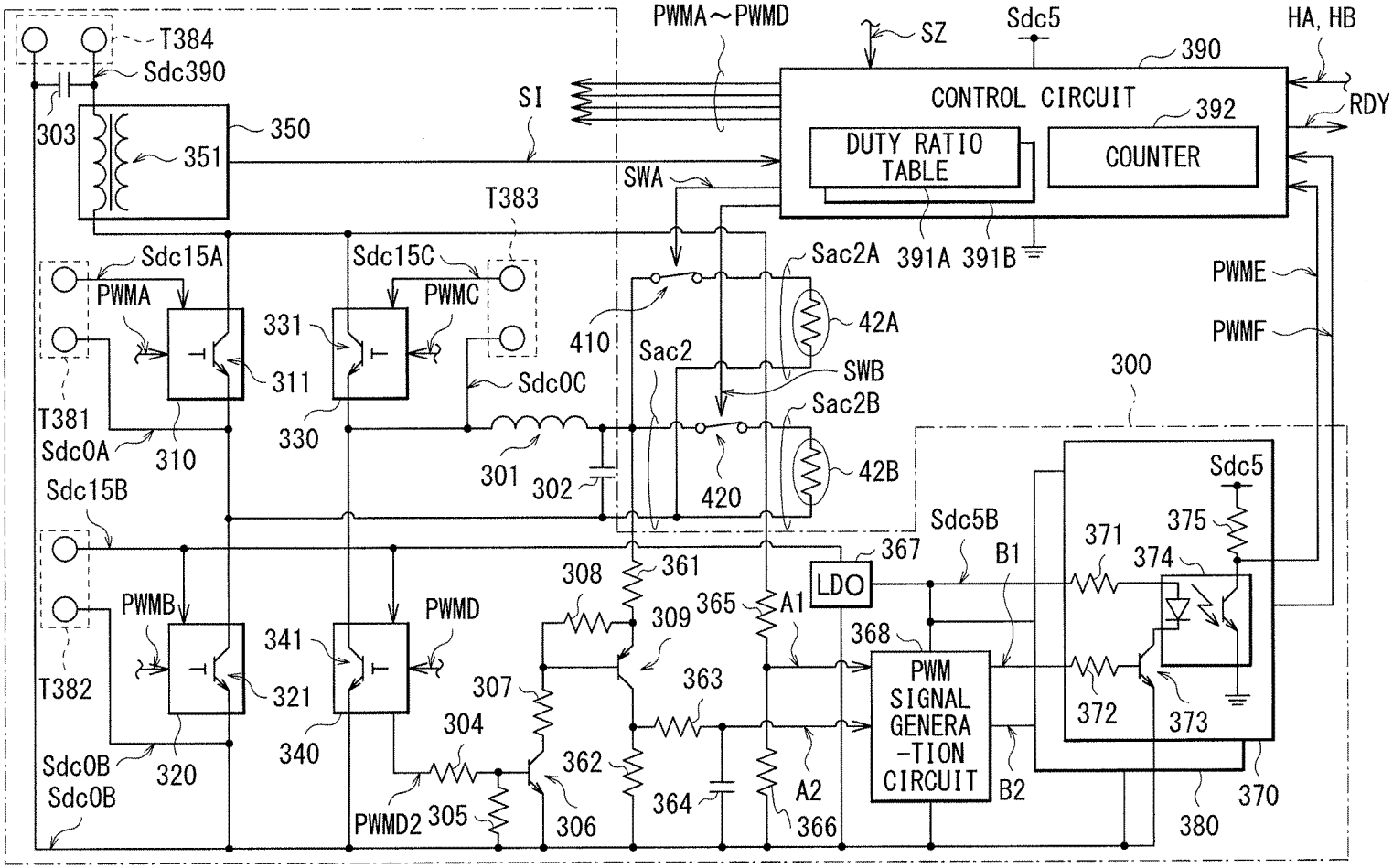
FIG. 8 is a circuit diagram illustrating an example of a configuration of a switching section illustrated in FIG. 4.

FIG. 8 illustrates an example of a configuration of the switching section 300. FIG. 8 also depicts the AC switches 410 and 420, the heaters 42A and 42B, and the control circuit 390, in addition to the switching section 300. The switching section 300 may include a capacitor 303, a current detection circuit 350, switching circuits 310, 320, 330, and 340, an inductor 301, and a capacitor 302. The switching section 300 may receive the signals Sdc15A and Sdc0A from the DC-DC converter 400A through a terminal T381, the signals Sdc15B and Sdc0B from the DC-DC converter 400B through a terminal T382, and the signals Sdc15C and Sdc0C from the DC-DC converter 400C through a terminal T383. The switching section 300 may also receive the signals Sdc390 and Sdc0B from the power factor correction circuit 100 from a terminal T384.

The capacitor 303 may have a first end that receives the signal Sdc390, and a second end that receives the signal Sdc0B. The current detection circuit 350 may detect the input current of the switching section 300.

Figure 9:
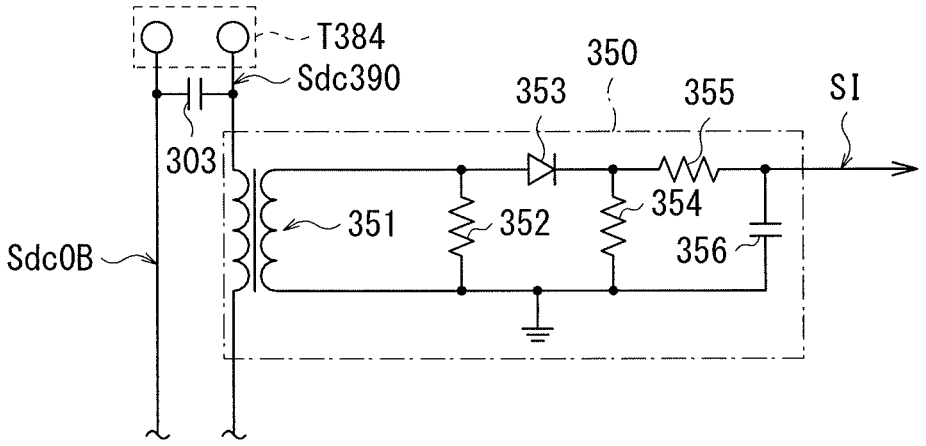
FIG. 9 is a circuit diagram illustrating an example of a configuration of a current detection circuit illustrated in FIG. 8.

FIG. 9 illustrates an example of a configuration of the current detection circuit 350. The current detection circuit 350 may include a current transformer 351, a resistor 352, a diode 353, resistors 354 and 355, and a capacitor 356. It is to be noted that FIG. 8 depicts the current transformer 351 among the elements mentioned above. The current transformer 351 may include a first winding that has a first end that receives the signal Sdc390, and that has a second end coupled to the switching circuits 310 and 330, and a first end of a resistor 365, as illustrated in FIG. 8. The current transformer 351 may include a second winding that has a first end coupled to a first end of the resistor 352 and an anode of the diode 353, and that has a second end that may be grounded. The first winding of the current transformer 351 may be wound, for example but not limited to, slightly less than one turn to about two turns both inclusive. The second winding may be wound, for example but not limited to, about 100 turns to 200 turns both inclusive. The resistor 352 may have the first end coupled to the first end of the second winding of the current transformer 351 and the anode of the diode 353, and a second end that may be grounded. The diode 353 may have the anode coupled to the first end of the second winding of the current transformer 351 and the first end of the resistor 352, and a cathode coupled to a first end of the resistor 354 and a first end of the resistor 355. The resistor 354 may have the first end coupled to the cathode of the diode 353 and the first end of the resistor 355, and a second end that may be grounded. The resistor 355 may have the first end coupled to the cathode of the diode 353 and the first end of the resistor 354, and a second end coupled to a first end of the capacitor 356. The capacitor 356 may have the first end coupled to the second end of the resistor 355, and a second end that may be grounded. The current detection circuit 350 may output, as the signal SI, a voltage at the second end of the resistor 355 and at the first end of the capacitor 356.

The switching circuit 310 as illustrated in FIG. 8 may perform a switching operation, based on the PWM (Pulse Width Modulation) signal PWMA.

Figure 10:
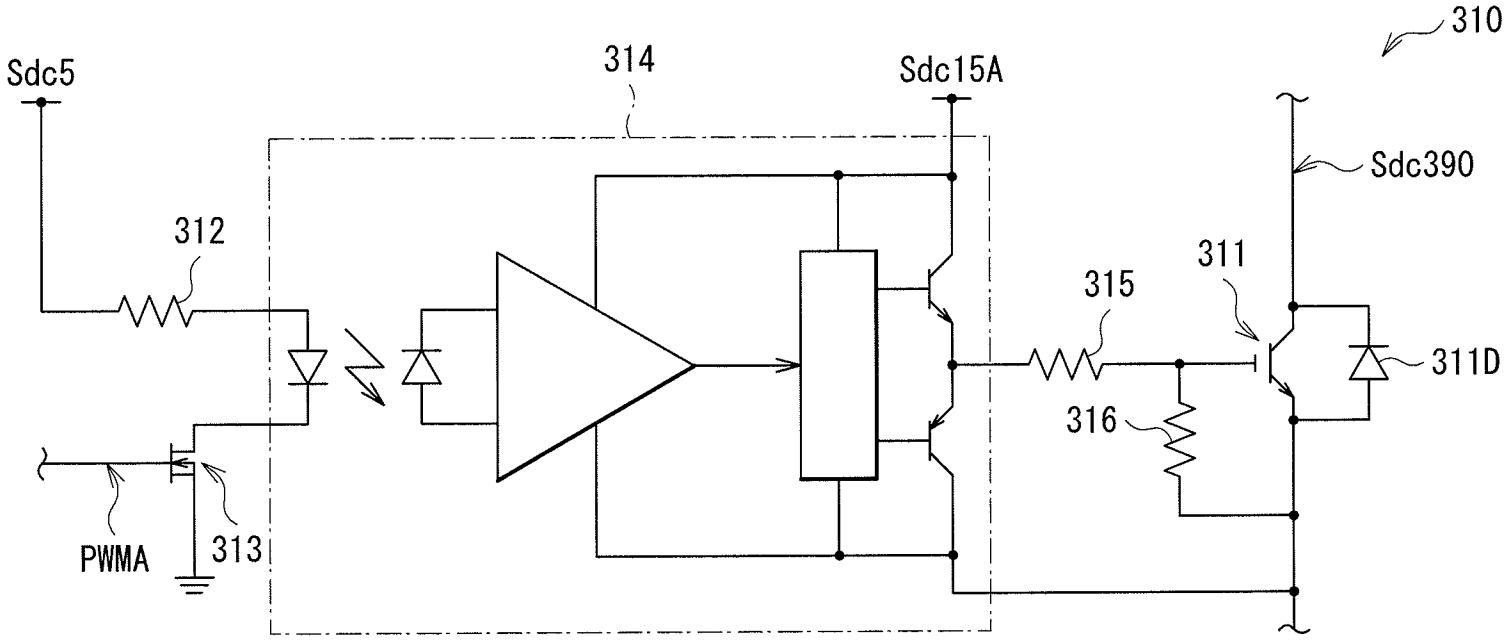
FIG. 10 is a circuit diagram illustrating an example of a configuration of a switching circuit illustrated in FIG. 8.

FIG. 10 illustrates an example of a configuration of the switching circuit 310. The switching circuit 310 may include a resistor 312, an N-channel FET 313, a photo coupler 314, resistors 315 and 316, an IGBT 311, and a diode 311D. It is to be noted that FIG. 8 depicts the IGBT 311 among the elements mentioned above.

The resistor 312 may have a first end that receives the signal Sdc5, and a second end coupled to an anode of a light-emitting diode of the photo coupler 314. The N-channel FET 313 may have a drain coupled to a cathode of the light-emitting diode of the photo coupler 314, a gate that receives the PWM signal PWMA, and a source that may be grounded. The anode of the light-emitting diode of the photo coupler 314 may be coupled to the second end of the resistor 312, and the cathode of the light-emitting diode thereof may be coupled to the drain of the N-channel FET 313. A collector of an NPN transistor of the photo coupler 314 may receive the signal Sdc15A, and an emitter of the NPN transistor thereof may be coupled to a first end of the resistor 315. An emitter of a PNP transistor of the photo coupler 314 may be coupled to the first end of the resistor 315, and a collector of the PNP transistor thereof may be coupled to a second end of the resistor 316, an emitter of the IGBT 311, and an anode of the diode 311D. The resistor 315 may have the first end coupled to the emitter of the NPN transistor and the emitter of the PNP transistor of the photo coupler 314, and a second end coupled to a base of the IGBT 311 and a first end of the resistor 316. The resistor 316 may have the first end coupled to the second end of the resistor 315 and the base of the IGBT 311, and the second end coupled to the collector of the PNP transistor of the photo coupler 314, the emitter of the IGBT 311, and the anode of the diode 311D. The IGBT 311 may have a collector coupled to a cathode of the diode 311D and that receives the signal Sdc390 as illustrated in FIG. 8, the base coupled to the second end of the resistor 315 and the first end of the resistor 316, and the emitter coupled to the anode of the diode 311D, the second end of the resistor 316, and the collector of the PNP transistor of the photo coupler 314. The emitter of the IGBT 311 may also be coupled to the switching circuit 320, a second end of the capacitor 302, and second ends of the heaters 42A and 42B, as illustrated in FIG. 8. The diode 311D may have the anode coupled to the emitter of the IGBT 311, the second end of the resistor 316, and the collector of the PNP transistor of the photo coupler 314, and the cathode coupled to the collector of the IGBT 311 and that receives the signal Sdc390.

The switching circuit 320 as illustrated in FIG. 8 may perform a switching operation, based on the PWM signal PWMB. The switching circuit 320 may have a configuration similar to the configuration of the switching circuit 310 illustrated in FIG. 10. The switching circuit 320 may include a photo coupler that receives the signal Sdc15B, and an IGBT 321. The IGBT 321 may correspond to the IGBT 311 in the switching circuit 310. The IGBT 321 may have a collector coupled to the emitter of the IGBT 311 in the switching circuit 310, the second end of the capacitor 302, the second ends of the heaters 42A and 42B, and an emitter that receives the signal Sdc0B.

The switching circuit 330 may perform a switching operation, based on the PWM signal PWMC. The switching circuit 330 may have a configuration similar to the configuration of the switching circuit 310 illustrated in FIG. 10. The switching circuit 330 may include a photo coupler that receives the signal Sdc15C, and an IGBT 331. The IGBT 331 may correspond to the IGBT 311 in the switching circuit 310. The IGBT 331 may have a collector that receives the signal Sdc390, and an emitter coupled to the switching circuit 340 and a first end of the inductor 301.

The switching circuit 340 may perform a switching operation, based on the PWM signal PWMD. The switching circuit 340 may have a configuration similar to the configuration of the switching circuit 310 illustrated in FIG. 10. The switching circuit 340 may include a photo coupler that receives the signal Sdc15B, and an IGBT 341. The IGBT 341 may correspond to the IGBT 311 in the switching circuit 310. The IGBT 341 may have a collector coupled to the emitter of the IGBT 331 in the switching circuit 330 and the first end of the inductor 301, and an emitter that receives the signal Sdc0B. The switching circuit 340 may output an output voltage of the photo coupler, as a signal PWMD2.

In this example embodiment, the IGBTs 311, 321, 331, and 341 are used; however, a switching device is not limited to an IGBT. In an alternative embodiment, a Si-FET, a SiC-FET, a GaN-FET, or any other suitable switching device may be used instead of the IGBT. Moreover, although a full-bridge configuration is used, this is illustrative and non-limiting. A half-bridge configuration may be also used.

The inductor 301 may have the first end coupled to the emitter of the IGBT 331 provided in the switching circuit 330 and the collector of the IGBT 341 provided in the switching circuit 340, and a second end coupled to a first end of the capacitor 302, a first end of the AC switch 410, and a first end of the AC switch 420. The capacitor 302 may have the first end coupled to the second end of the inductor 301, the first end of the AC switch 410, and the first end of the AC switch 420, and the second end coupled to the emitter of the IGBT 311 provided in the switching circuit 310, the collector of the IGBT 321 provided in the switching circuit 320, and the second end of the heater 42A, and the second end of the heater 42B.

The switching section 300 may further include the resistor 365 and a resistor 366, resistors 304 and 305, an NPN transistor 306, resistors 307 and 308, a PNP transistor 309, resistors 361 to 363, a capacitor 364, an LDO (low drop out linear regulator) 367, a PWM signal generation circuit 368, and circuits 370 and 380.

The resistor 365 may have the first end coupled to the second end of the first winding of the current transformer 351 provided in the current detection circuit 350, and a second end coupled to a first end of the resistor 366. The resistor 366 may have the first end coupled to the second end of the resistor 365, and a second end that receives the signal Sdc0B. A voltage at the second end of the resistor 365 and at the first end of the resistor 366 may be supplied, as a signal A1, to the PWM signal generation circuit 368.

The resistor 304 may have a first end that receives the signal PWMD2, and a second end coupled to the first end of the resistor 305 and a base of the NPN transistor 306. The resistor 305 may have a first end coupled to the second end of the resistor 304 and the base of the NPN transistor 306, and a second end that receives the signal Sdc0B. The NPN transistor 306 may have a collector coupled to a second end of the resistor 307, the base coupled to the second end of the resistor 304 and the first end of the resistor 305, and an emitter that receives the signal Sdc0B. The resistor 307 may have a first end coupled to a base of the PNP transistor 309 and a second end of the resistor 308, and the second end coupled to the collector of the NPN transistor 306. The resistor 308 may have a first end coupled to an emitter of the PNP transistor 309 and a second end of the resistor 361, and the second end coupled to the base of the PNP transistor 309 and the first end of the resistor 307. The PNP transistor 309 may have the emitter coupled to the first end of the resistor 308 and the second end of the resistor 361, the base coupled to the first end of the resistor 307 and the second end of the resistor 308, and a collector coupled to a first end of the resistor 362 and a first end of the resistor 363. The resistor 362 may have the first end coupled to the collector of the PNP transistor 309 and the first end of the resistor 363, and a second end that receives the signal Sdc0B. The resistor 363 may have the first end coupled to the collector of the PNP transistor 309 and the first end of the resistor 362, and a second end coupled to a first end of the capacitor 364. The capacitor 364 may have the first end coupled to the second end of the resistor 363, and a second end that receives the signal Sdc0B. A voltage at the second end of the resistor 363 and at the first end of the capacitor 364 maybe supplied, as a signal A2, to the PWM signal generation circuit 368.

The LDO 367 may generate a signal Sdc5B, based on the signals Sdc15B and Sdc0B. In this example embodiment, a voltage of the signal Sdc5B may be higher by 5 V than the voltage of the signal Sdc0B. The PWM signal generation circuit 368 may generate a PWM signal B1 having a duty ratio corresponding to a voltage of the signal A1, and may generate a PWM signal B2 having a duty ratio corresponding to a voltage of the signal A2. In one specific but non-limiting example, the PWM signal generation circuit 368 may allow the duty ratio of the PWM signal B1 to be, for example, 100% when the voltage of the signal A1 is 5 V, may allow the duty ratio of the PWM signal B1 to be, for example, 50% when the voltage of the signal A1 is 2.5 V, and may allow the duty ratio of the PWM signal B1 to be, for example, 0% when the voltage of the signal A1 is 0 V. The same may apply to the signals A2 and B2.

The circuit 370 may generate the PWM signal PWME, based on the PWM signal B1. The circuit 370 may include resistors 371 and 372, an NPN transistor 373, a photo coupler 374, and a resistor 375. The resistor 371 may have a first end that receives the signal Sdc5B, and a second end coupled to an anode of a light-emitting diode of the photo coupler 374. The resistor 372 may have a first end that receives the signal B1, and a second end coupled to a base of the NPN transistor 373. The NPN transistor 373 may have a collector coupled to a cathode of the light-emitting diode of the photo coupler 374, the base coupled to the second end of the resistor 372, and an emitter that receives the signal Sdc0B. The photo coupler 374 may include the light-emitting diode and an NPN transistor. The light-emitting diode of the photo coupler 374 may have the anode coupled to the second end of the resistor 371, and the cathode coupled to the collector of the NPN transistor 373. The NPN transistor of the photo coupler 374 may have a collector coupled to a second end of the resistor 375, and an emitter that may be grounded. The resistor 375 may have a first end that receives the signal Sdc5, and the second end coupled to the collector of the NPN transistor of the photo coupler 374. A voltage at the second end of the resistor 375 may be supplied, as the signal PWME, to the control circuit 390.

The circuit 380 may generate the PWM signal PWMF, based on the PWM signal B2. The circuit 380 may have a similar configuration to the configuration of the circuit 370.

The AC switch 410 as illustrated in FIG. 4 may supply, based on a switch control signal SWA, the alternating-current signal Sac2, as the alternating-current signal Sac2A, to the heater 42A. As illustrated in FIG. 8, the AC switch 410 may have a first end coupled to the second end of the inductor 301 and the first end of the capacitor 302, and a second end coupled to a first end of the heater 42A.

Figure 11:
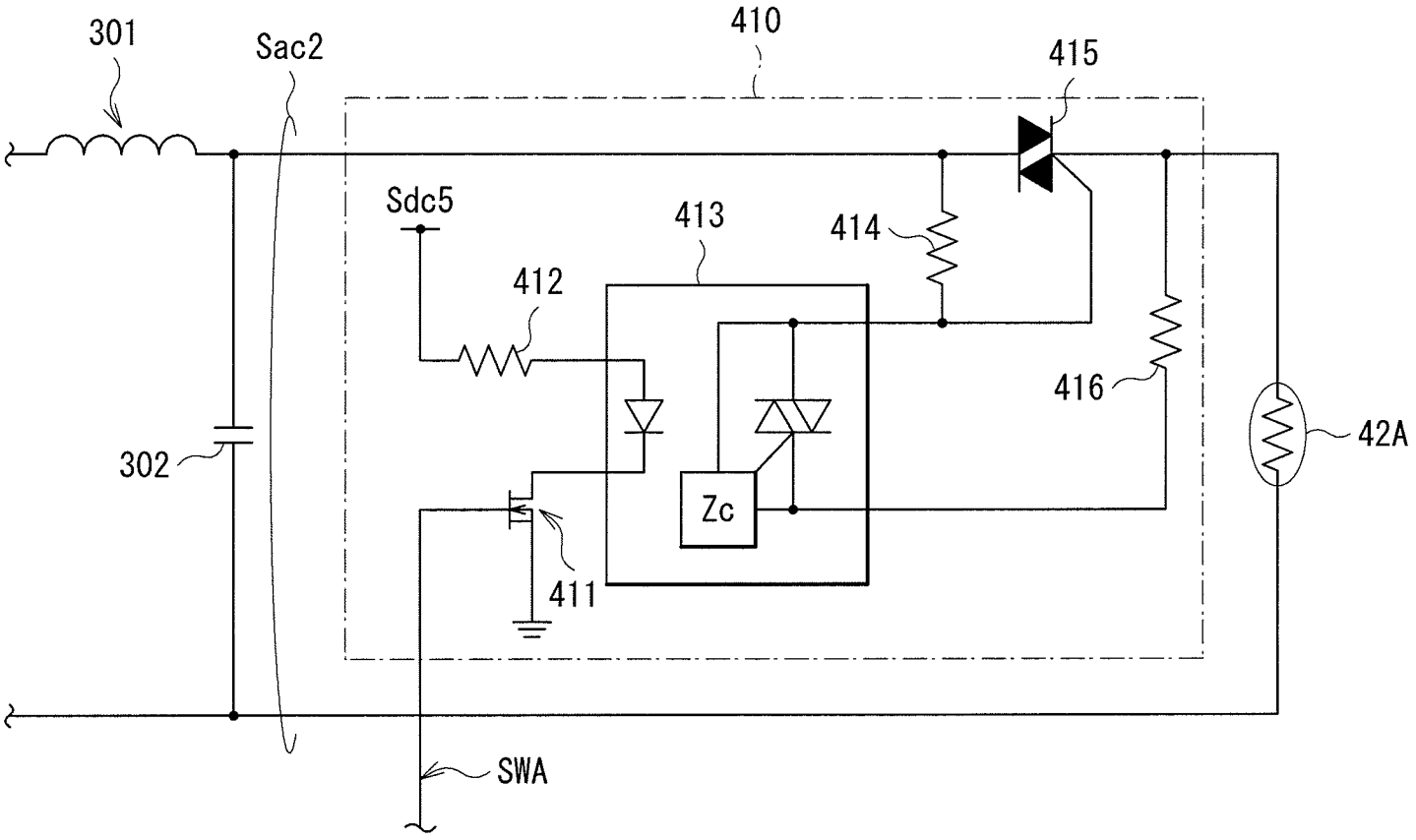
FIG. 11 is a circuit diagram illustrating an example of a configuration of an AC switch illustrated in FIG. 8.

FIG. 11 illustrates an example of a configuration of the AC switch 410. FIG. 11 also depicts the inductor 301, the capacitor 302, and the heater 42A, in addition to the AC switch 410. The AC switch 410 may include an N-channel FET 411, a resistor 412, a photo triac coupler 413, a resistor 414, a triac 415, and a resistor 416. The N-channel FET 411 may have a drain coupled to a cathode of a light-emitting diode of the photo triac coupler 413, a gate that receives the switch control signal SWA, and a source that may be grounded. The resistor 412 may have a first end that receives the signal Sdc5, and a second end coupled to an anode of the light-emitting diode of the photo triac coupler 413. The photo triac coupler 413 may be of a so-called zero-cross type. The photo triac coupler 413 may include the light-emitting diode and a triac. The light-emitting diode of the photo triac coupler 413 may have the anode coupled to the second end of the resistor 412, and the cathode coupled to the drain of the N-channel FET 411. The triac of the photo triac couple 413 may have a first end coupled to a second end of the resistor 414 and a gate of the triac 415, and a second end coupled to a second end of the resistor 416. The resistor 414 may have a first end coupled to a first end of the triac 415, and the second end coupled to the gate of the triac 415 and the first end of the triac of the photo triac coupler 413. The triac 415 may have the first end coupled to the first end of the resistor 414, the second end of the inductor 301, and the first end of the capacitor 302, a second end coupled to a first end of the resistor 416 and the first end of the heater 42A, and the gate coupled to the second end of the resistor 414 and the first end of the triac of the photo triac coupler 413. The resistor 416 may have the first end coupled to the second end of the triac 415, and the second end coupled to the second end of the triac of the photo triac couple 413. With this configuration, the AC switch 410 may be turned on and off, in response to the switch control signal SWA, at a zero-cross timing of the alternating-current signal Sac2.

The AC switch 420 as illustrated in FIG. 4 may supply, based on the switch control signal SWB, the alternating-current signal Sac2, as the alternating-current signal Sac2B, to the heater 42B. As illustrated in FIG. 8, the AC switch 420 may have a first end coupled to the second end of the inductor 301 and the first end of the capacitor 302, and a second end coupled to a first end of the heater 42B. The AC switch 420 may have a similar configuration to the configuration of the AC switch 410 as illustrated in FIG. 11.

The control circuit 390 may control the switching operation performed in each of the switching circuits 310, 320, 330, and 340. The control circuit 390 may have a configuration that uses, for example but not limited to, an Application Specific Integrated Circuit (ASIC), a Field Programmable Gate Array (FPGA), a microcontroller, or any other suitable control circuit. The control circuit 390 may supply the switching circuits 310, 320, 330, and 340 with their respective PWM signals PWMA, PWMB, PWMC, and PWMD to so control the switching section 300 as to generate the alternating-current signal Sac2. In one specific but non-limiting example, the control circuit 390 may perform switching of each of the IGBTs 331 and 341 at 50 Hz without limitation, and may perform switching of each of the IGBTs 311 and 321 at 20 kHz without limitation. In this example embodiment, a switching frequency of each of the IGBTs 311 and 321 is set to 20 kHz. It is to be noted that the switching frequency is not limited thereto; the switching frequency of each of the IGBTs 311 and 321 may be preferably set at 20 kHz or higher. Such a frequency is higher than a human audible range, making it possible to make a sound (a noise) resulting from the switching of each of the IGBTs 311 and 321 less audible even when the sound is generated. In one embodiment where a frequency well higher than 20 kHz is preferable, a GaN-FET may be used without limitation instead of the IGBT.

Figure 12:
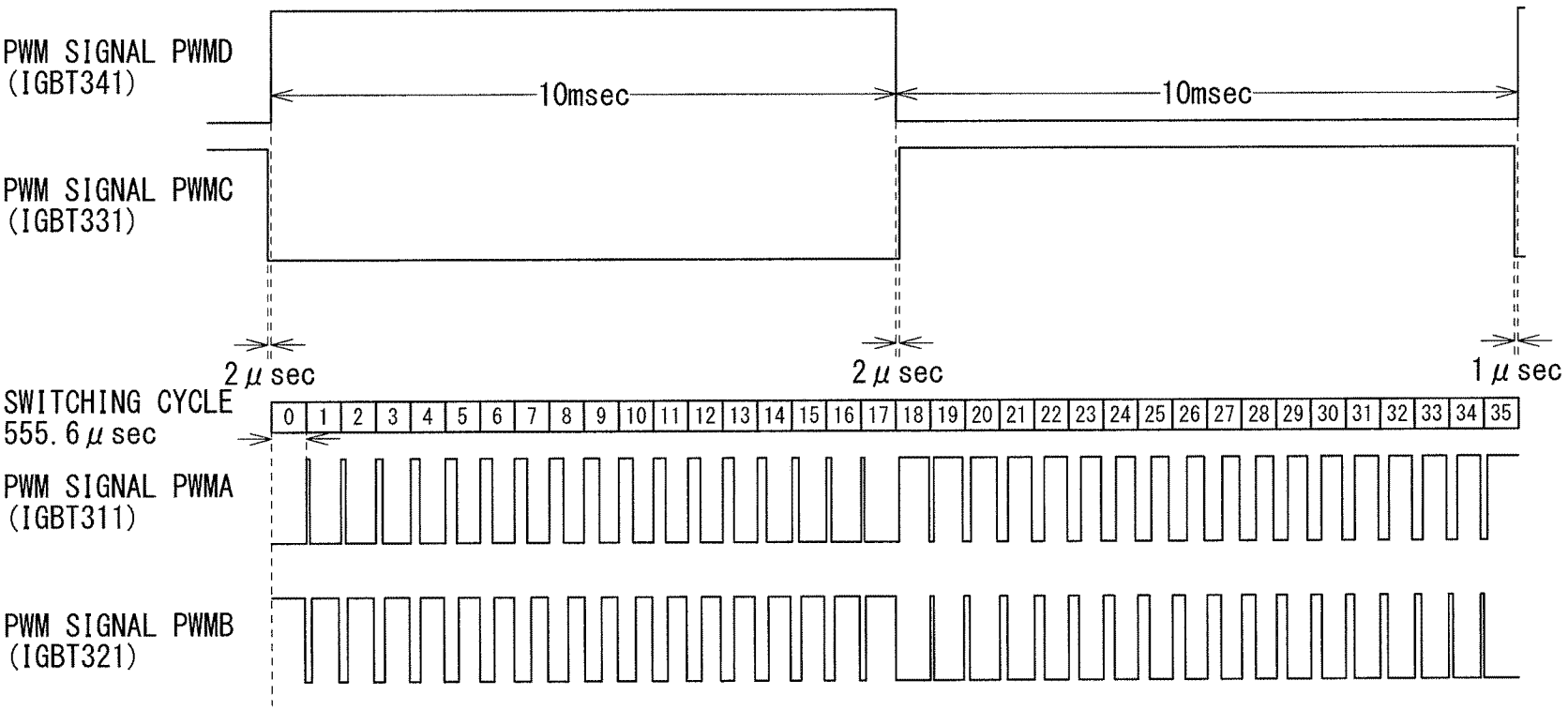
FIG. 12 is a timing waveform chart illustrating an example of an operation of a DC-AC inverter illustrated in FIG. 4.

FIG. 12 illustrates an example of the PWM signals PWMA, PWMB, PWMC, and PWMD. For convenience of description, the switching frequency of each of the IGBTs 311 and 321 is set to 1.8 kHz in one non-limiting example illustrated in FIG. 12. In the illustrated example, the IGBT 311 is turned on when the PWM signal PWMA is at a high level, whereas the IGBT 311 is turned off when the PWM signal PWMA is at a low level. The same applies to the PWM signals PWMB, PWMC, and PWMD.

Referring to FIG. 12, the control circuit 390 may set the PWM signal PWMC to the low level and the PWM signal PWMD to the high level during a first half of one period of each of the PWM signals PWMC and PWMD, thereby causing the IGBT 331 to be turned off and the IGBT 341 to be turned on. Also, the control circuit 390 may set the PWM signal PWMC to the high level and the PWM signal PWMD to the low level during a latter half of the one period of each of the PWM signals PWMC and PWMD, thereby causing the IGBT 331 to be turned on and the IGBT 341 to be turned off. The control circuit 390 may so control the switching section 300 as to prevent both the IGBTs 331 and 341 from being turned on together. In one specific but non-limiting example, the control circuit 390 may cause the IGBT 341 to be turned on after the IGBT 331 is turned off, and may cause the IGBT 331 to be turned on after the IGBT 341 is turned off, as illustrated in FIG. 12. In this example, duration during which both the IGBTs 331 and 341 are turned off (i.e., a dead time) may be set to 2 (two) microseconds without limitation.

The control circuit 390 may also vary a duty ratio of each of the PWM signals PWMA and PWMB gradually as illustrated in FIG. 12. This makes it possible for the DC-AC inverter 62 to generate the alternating-current signal Sac2 in the form of sine wave. The dead time of 2 microseconds without limitation may also be provided for the switching section 300 to prevent the IGBTs 311 and 321 from being turned on together.

As illustrated in FIG. 12, the IGBT 341 may be turned on during the first half of the one period of each of the PWM signals PWMC and PWMD. Accordingly, causing the IGBT 311 to be turned on in the switching section 300 allows a current to flow in order of the IGBT 311, the heaters 42A and 42B, the inductor 301, and the IGBT 341. Also, the IGBT 331 may be turned on during the latter half of the one period of each of the PWM signals PWMC and PWMD. Accordingly, causing the IGBT 321 to be turned on in the switching section 300 allows a current to flow in order of the IGBT 331, the inductor 301, the heaters 42A and 42B, and the IGBT 321. The DC-AC inverter 62 may generate the alternating-current signal Sac2 in this manner.

The control circuit 390 may selectively generate either the PWM signals PWMA, PWMB, PWMC, and PWMD having a cycle of 19.9 microseconds, or the PWM signals PWMA, PWMB, PWMC, and PWMD having a cycle of 20.1 microseconds, upon generating the PWM signals PWMA, PWMB, PWMC, and PWMD.

Figure 13:
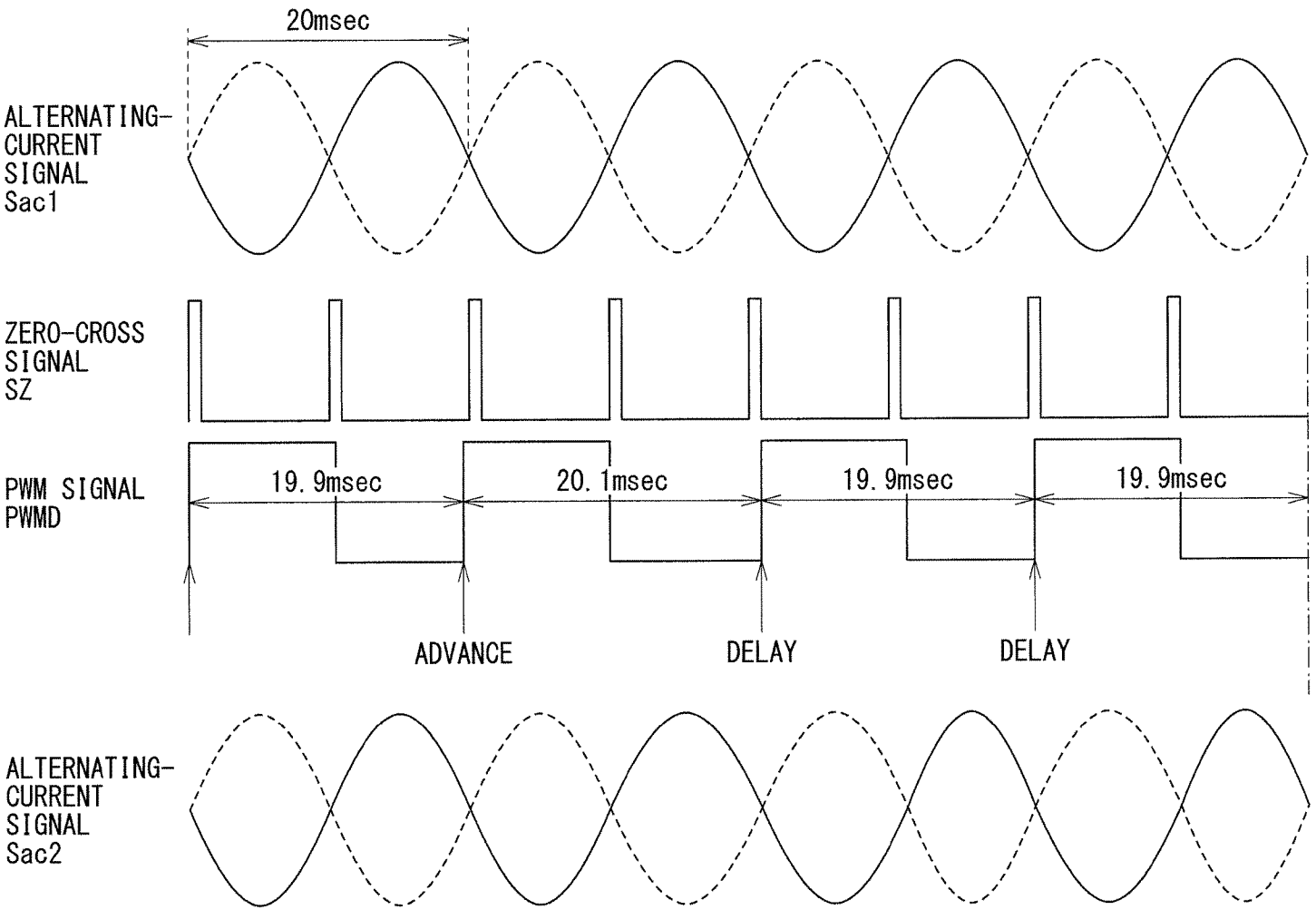
FIG. 13 is another timing waveform chart illustrating an example of an operation of the DC-AC inverter illustrated in FIG. 4.

FIG. 13 illustrates an example of an operation of the control circuit 390. In this example embodiment, since the frequency of the alternating-current signal Sac1 is 50 Hz, pulses of the zero-cross signal SZ may appear in a cycle of 10 microseconds. In this example embodiment, the control circuit 390 may compare a phase of a rising edge of the zero-cross signal SZ to a phase of a rising edge of the PWM signal PWMD. When the phase of the PWM signal PWMD is advanced, the control circuit 390 may generate the PWM signals PWMA, PWMB, PWMC, and PWMD having the cycle of 20.1 microseconds. When the phase of the PWM signal PWMD is delayed, the control circuit 390 may generate the PWM signals PWMA, PWMB, PWMC, and PWMD having the cycle of 19.9 microseconds. Thus, the control circuit 390 may perform a control to allow the frequency of the alternating-current signal Sac2 to be closer to the frequency of the alternating-current signal Sac1. This may result in a substantial coincidence of an average value of the frequency of the alternating-current signal Sac2 with the frequency of the alternating-current signal Sac1.

In this example embodiment, the control circuit 390 compares the phase of the rising edge of the zero-cross signal SZ to the phase of the rising edge of the PWM signal PWMD. However, this is illustrative and non-limiting. For example, instead of the rising edge of the zero-cross signal SZ, a falling edge of the zero-cross signal SZ may be used. Alternatively, for example, instead of the PWM signal PWMD, the PWM signal PWMC may be used.

Figure 14:
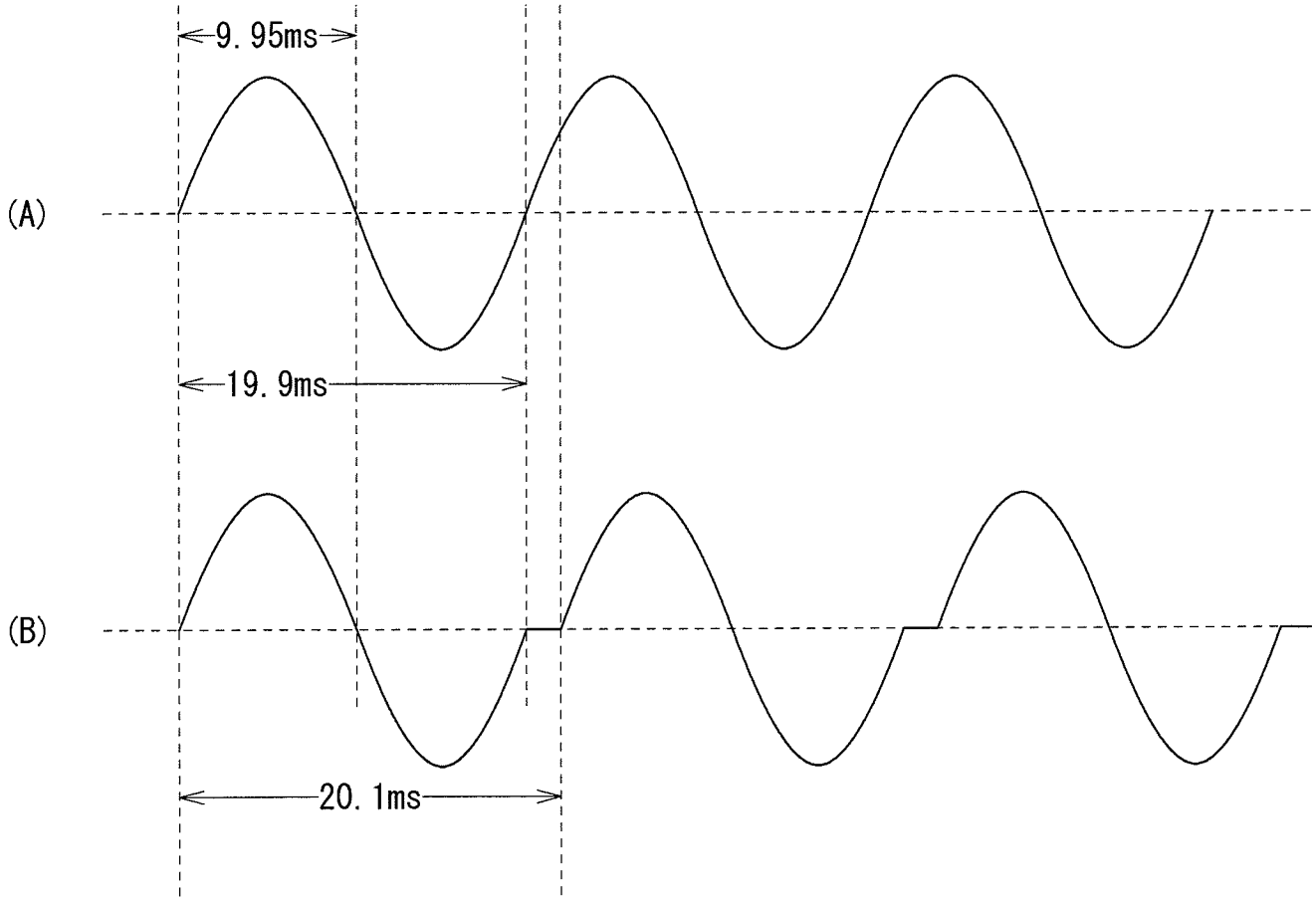
FIG. 14 is another timing waveform chart illustrating an example of an operation of the DC-AC inverter illustrated in FIG. 4.

(A) of FIG. 14 illustrates a waveform of the alternating-current signal Sac2 generated based on the PWM signals PWMA, PWMB, PWMC, and PWMD having the cycle of 19.9 microseconds. (B) of FIG. 14 illustrates a waveform of the alternating-current signal Sac2 generated based on the PWM signals PWMA, PWMB, PWMC, and PWMD having the cycle of 20.1 microseconds. In this example embodiment, the waveforms of the alternating-current signal Sac2 may be same in both cases until 19.9 microseconds. In other words, the PWM signals PWMA, PWMB, PWMC, and PWMD having the cycle of 19.9 microseconds may be same, until 19.9 microseconds, as the PWM signals PWMA, PWMB, PWMC, and PWMD. Then, the alternating-current signal Sac2 generated based on the PWM signals PWMA, PWMB, PWMC, and PWMD having the 20.1 microseconds may become 0V during a term from 19.9 microseconds to 20.1 microseconds.

Since the switching frequency of the IGBTs 311 and 321 is 20 kHz, the number of the switching cycles may be 402 (0 to 401) in generating the PWM signals PWMA and PWMB having the cycle of 20.1 microseconds. For example, in generating the alternating-current signal Sac2 of 390 Vp, a switching duty ratio DUTY in each switching cycle CYCLE may be obtained with use of the following expression.

[Expression 1]

$$\text{DUTY} = \begin{cases} \text{Sin}\left(\pi \times \frac{\text{CYCLE}}{198}\right) & (\text{CYCLE: } 0\sim198) \\ 1 - \text{Sin}\left(\pi \times \frac{\text{CYCLE} - 198}{198}\right) & (\text{CYCLE: } 199\sim397) \\ 0 & (\text{CYCLE: } 398\sim401) \end{cases} \quad (1)$$

In the meanwhile, in generating the PWM signals PWMA and PWMB having the cycle of 19.9 microseconds, the number of the switching cycles may be 398 (0 to 397). Accordingly, in this case, the Expression (1) may be used, with the switching cycle CYCLE ranging from 0 to 397 both inclusive.

In this example embodiment, the control circuit 390 selectively generates either the PWM signals PWMA, PWMB, PWMC, and PWMD having the cycle of 19.9 microseconds, or the PWM signals PWMA, PWMB, PWMC, and PWMD having the cycle of 20.1 microseconds. However, the cycles are not limited thereto. Any cycles different from one another may be set.

When the frequency of the alternating-current signal Sac1 is 60 Hz, the control circuit 390 may allow the IGBTs 331 and 341 to perform switching at 60 Hz, and may allow the IGBTs 311 and 321 to perform switching at 20 Hz. In this case, the control circuit 390 may selectively generate either the PWM signals PWMA, PWMB, PWMC, and PWMD having a cycle of 16.5 microseconds, or the PWM signals PWMA, PWMB, PWMC, and PWMD having a cycle of 16.8 microseconds. In generating the PWM signals PWMA, PWMB, PWMC, and PWMD having the cycle of 16.8 microseconds, the number of the switching cycles may be 336 (0 to 335). For example, in generating the alternating-current signal Sac2 of 390 Vp, the switching duty ratio DUTY in each switching cycle CYCLE may be obtained with use of the following expression.

[Expression 2]

$$\text{DUTY} = \begin{cases} \text{Sin}\left(\pi \times \frac{\text{CYCLE}}{164}\right) & (\text{CYCLE: } 0\sim164) \\ 1 - \text{Sin}\left(\pi \times \frac{\text{CYCLE} - 164}{164}\right) & (\text{CYCLE: } 165\sim329) \\ 0 & (\text{CYCLE: } 330\sim335) \end{cases} \quad (2)$$

In the meanwhile, in generating the PWM signals PWMA and PWMB having the cycle of 16.5 microseconds, the number of the switching cycles may be 330 (0 to 329). Accordingly, in this case, the expression (2) may be used, with the switching cycle CYCLE ranging from 0 to 329 both inclusive.

Referring to FIG. 8, the control circuit 390 may include a duty ratio table 391A, a duty ratio table 391B, and a counter 392.

The duty ratio tables 391A and 391B may represent switching duty ratios for each switching cycle of the IGBTs 311 and 321. The duty ratio table 391A may be used in a case in which the frequency of the alternating-current signal Sac1 is 50 Hz. The duty ratio table 391B may be used in a case in which the frequency of the alternating-current signal Sac1 is 60 Hz.

In this example embodiment, the duty ratio table 391A may include thirteen tables 391A1 to 391A13. The table 391A1 may be obtained by multiplying a right side of the expression (1) by 0.3. The table 391A2 may be obtained by multiplying the right side of the expression (1) by 0.35. The table 391A3 may be obtained by multiplying the right side of the expression (1) by 0.4. The same may apply to the tables 391A4 to 391A12. The table 391A13 may be obtained by multiplying the right side of the expression (1) by 0.9.

In this example embodiment, the duty ratio table 391B may include thirteen tables 391B1 to 391B13. The table 391B1 may be obtained by multiplying a right side of the expression (2) by 0.3. The table 391B2 may be obtained by multiplying the right side of the expression (2) by 0.35. The table 391B3 may be obtained by multiplying the right side of the expression (2) by 0.4. The same may apply to the tables 391B4 to 391B12. The table 391B13 may be obtained by multiplying the right side of the expression (2) by 0.9.

The counter 392 may count the number of the switching cycles.

The control circuit 390 may generate the PWM signals PWMA and PWMB with use of the duty ratio tables 391A and 391B described above. In one specific but non-limiting example, first, the control circuit 390 may detect, based on the zero-cross signal SZ, the frequency of the alternating-current signal Sac1, and may select one of the duty ratio table 391A and the duty ratio table 391B, based on a detection result. Then, the control circuit 390 may select one of the thirteen tables 391 included in the selected duty ratio table. The control circuit 390 may sequentially read out, from the duty ratio table 391, the switching duty ratio that is associated with the switching cycle that corresponds to a value of the counter 392, and may generate the PWM signals PWMA and PWMB, based on the read out switching duty ratios.

Figure 15:
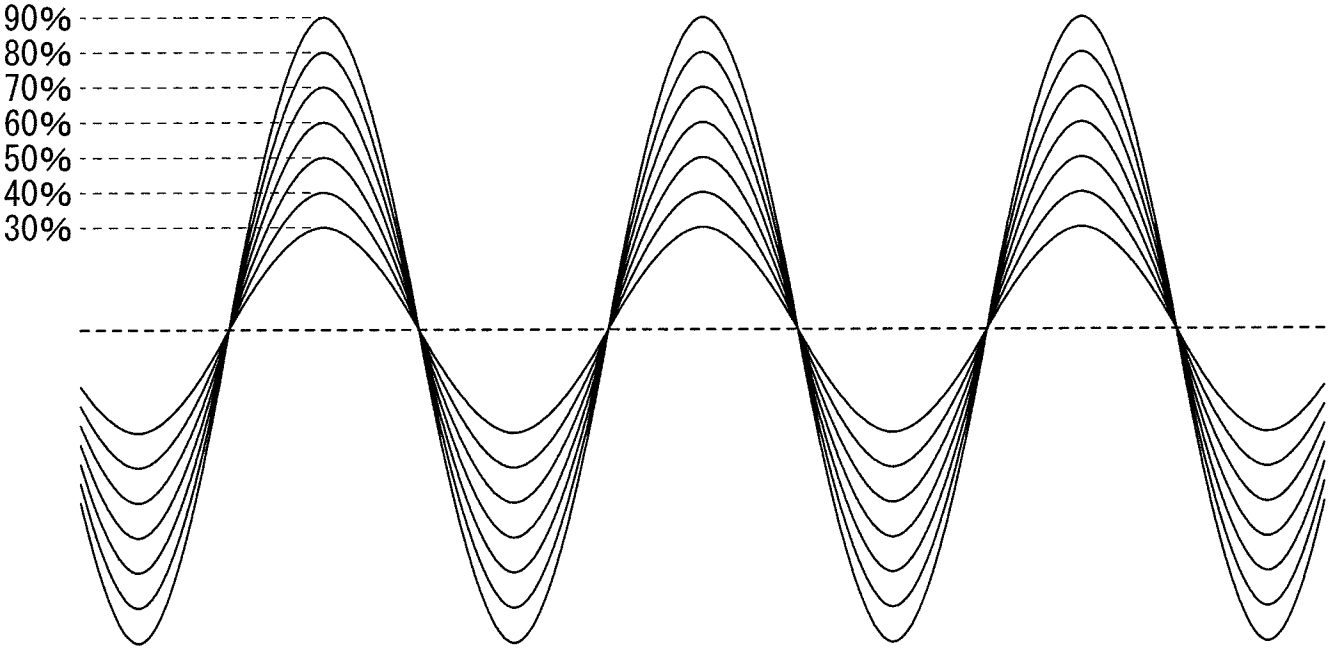
FIG. 15 is another timing waveform chart illustrating an example of an operation of the DC-AC inverter illustrated in FIG. 4.

FIG. 15 illustrates one example of the alternating-current signal Sac2. In a case with use of, for example, the tables 391A1 and 391B1, an amplitude of the alternating-current signal Sac2 may be 30% (117 Vp in this example) of the voltage of the signal Sdc390 (390 V in this example). In a case with use of, for example, the tables 391A13 and 391B13, the amplitude of the alternating-current signal Sac2 may be 90% (351 Vp in this example) of the voltage of the signal Sdc390 (390 V in this example). In this way, the DC-AC inverter 62 may set the amplitude of the alternating-current signal Sac2 in increments of 5% within a range of 30% to 90%, both inclusive, of the voltage of the signal Sdc390 (390 V in this example).

When the heater control signal HA is enabled, the control circuit 390 may enable the switch control signal SWA and may generate the PWM signals PWMA, PWMB, PWMC, and PWMD as illustrated in FIG. 12. This causes the alternating-current signal Sac2 generated by the switching section 300 to be supplied to the heater 42A through the AC switch 410. Similarly, when the heater control signal HB is enabled, the control circuit 390 may enable the switch control signal SWB and may generate the PWM signals PWMA, PWMB, PWMC, and PWMD as illustrated in FIG. 12. This causes the alternating-current signal Sac2 generated by the switching section 300 to be supplied to the heater 42B through the AC switch 420.

At this occasion, as described later, at the start of the electric power supply to one or both of the heaters 42A and 42B, the control circuit 390 may select the above-described thirteen tables 391A1 to 391A13 in turn, and may operate to gradually increase the amount of the electric power supply. If electrification to the heaters 42A and 42B is started while the heaters 42A and 42B are still cold, a rush current may become large because of low resistance values of the heaters 42A and 42B. The control circuit 390 may therefore first set the amount of the electric power supply to a low level. When the heaters 42A and 42B are heated enough to lower a current, the control circuit 390 may increase the amount of the electric power supply. In this way, the control circuit 390 may perform a so-called slow-up control at the start of the electric power supply to the heaters 42A and 42B, to gradually increase the amount of the electric power supply.

The control circuit 390 may also have a function of stopping the generation of the alternating-current signal Sac2, by allowing the switching section 300 to operate in a standby mode, in a case in which both the heater control signals HA and HB are disabled.

Figure 16:
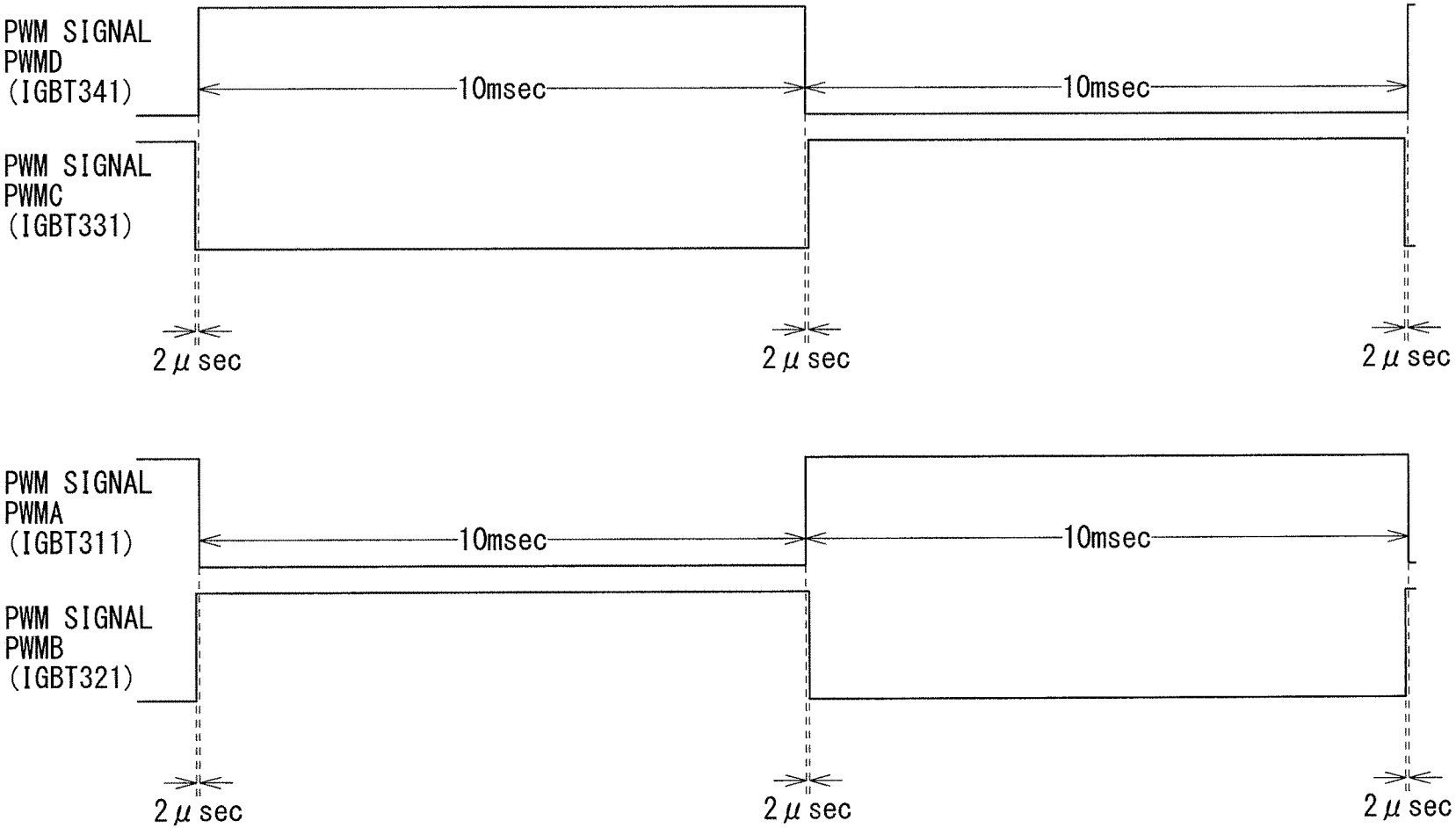
FIG. 16 is another timing waveform chart illustrating an example of an operation of the DC-AC inverter illustrated in FIG. 4.

FIG. 16 illustrates an example of the PWM signals PWMA, PWMB, PWMC, and PWMD upon stopping the generation of the alternating-current signal Sac2. The control circuit 390 may set the PWM signals PWMA and PWMC to a low level and set the PWM signals PWMB and PWMD to a high level during a first half of a period illustrated in FIG. 16, thereby causing the IGBTs 311 and 331 to be turned off and the IGBTs 321 and 341 to be turned on. This prevents the switching section 300 from generating the alternating-current signal Sac2. The control circuit 390 may set the PWM signals PWMA and PWMC to a high level and set the PWM signals PWMB and PWMD to a low level during a latter half of the period illustrated in FIG. 16, thereby causing the IGBTs 311 and 331 to be turned on and the IGBTs 321 and 341 to be turned off. This also prevents the switching section 300 from generating the alternating-current signal Sac2. In this manner, the control circuit 390 may stop the generation of the alternating-current signal Sac2.

The control circuit 390 may also have a function of obtaining, based on the signal SI, an input current value Iin of the DC-AC inverter 62.

Figure 17:
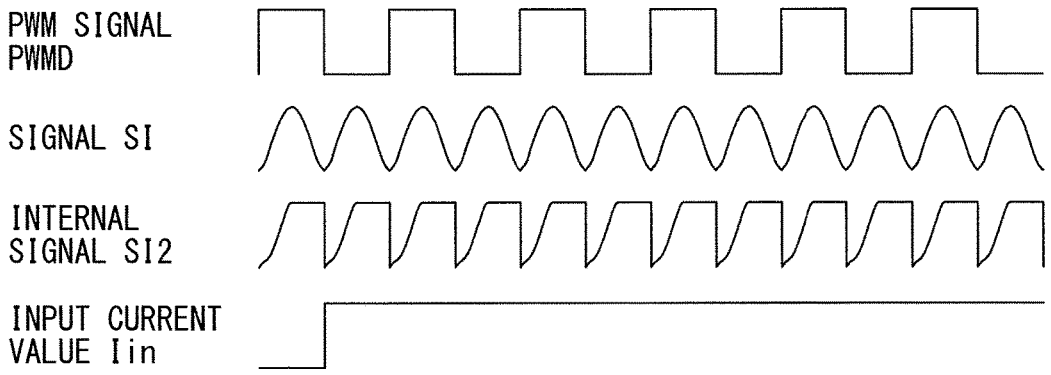
FIG. 17 is a timing waveform chart illustrating an example of an operation of the switching section and a control circuit illustrated in FIG. 8.

FIG. 17 illustrates an operation of obtaining, based on the signal SI, the input current value Iin in the switching section 300. The current detection circuit 350 may generate the signal SI corresponding to the PWM signals PWMA, PWMB, PWMC, and PWMD. The signal SI may be, for example, a signal having a frequency twice as high as the frequency of the PWM signal PWMD. The control circuit 390 may perform A/D conversion by sampling the signal SI in a sampling cycle of, for example, 1 microsecond or less. Then, the control circuit 390 may perform, on an A/D converted signal, a peak hold operation in a unit of a half cycle of the PWM signal PWMD, and may reset a peak hold value at a transition timing of the PWM signal PWMD, thereby obtaining an internal signal SI2. At this occasion, immediately before resetting the peak hold value, the control circuit 390 may latch the peak hold value, thereby obtaining the input current value Iin.

The control circuit 390 may also have a function of obtaining, based on the signal PWME, a voltage value (an input voltage value Vin) of the signal Sdc390 inputted to the DC-AC inverter 62. As illustrated in FIG. 8, the signal Sdc390 supplied to the switching section 300 may be voltage-divided by the resistors 365 and 366, and a signal obtained by the voltage-division may be supplied, as the signal A1, to the PWM signal generation circuit 368. The PWM signal generation circuit 368 may generate the PWM signal B1 having a duty ratio corresponding to a voltage of the signal A1. Then, the circuit 370 may generate the PWM signal PWME, based on the PWM signal B1. The control circuit 390 may obtain the input voltage value Vin, based on the PWM signal PWME.

The control circuit 390 may also have a function of obtaining, based on the signal PWMF, an effective value (an output voltage value Vout) of the alternating-current signal Sac2 generated by the DC-AC inverter 62. As illustrated in FIG. 8, the signal A2 may be generated based on a signal at the first end of the capacitor 302 and the signal PWMD2.

Figure 18:
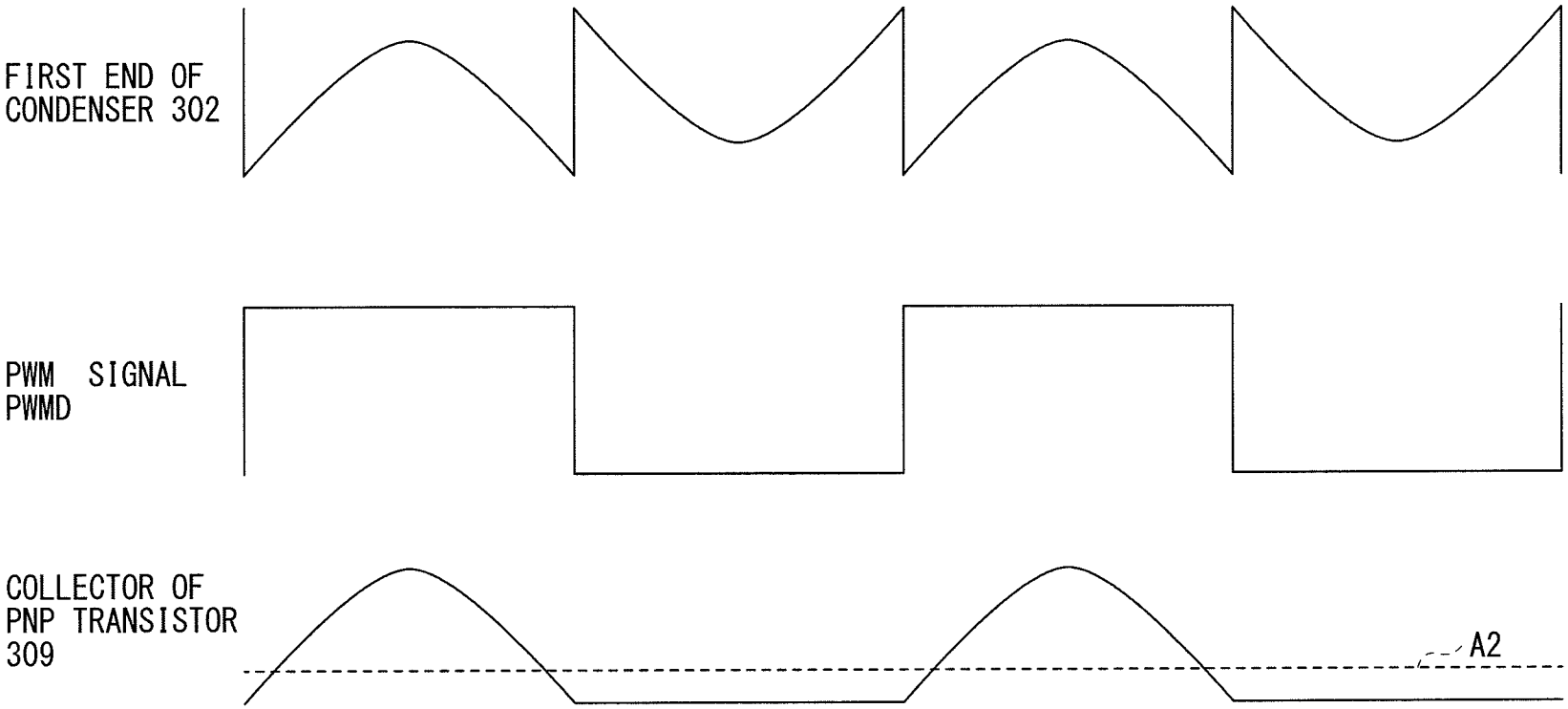
FIG. 18 is a timing waveform chart illustrating an example of an operation of the switching section illustrated in FIG. 8.

FIG. 18 illustrates an operation of generating the signal A2. In response to the PWM signals PWMA, PWMB, PWMC, and PWMD, a waveform as illustrated in FIG. 18 may appear at the first end of the capacitor 302. At this occasion, a waveform as illustrated in FIG. 18 may appear at the collector of the PNP transistor 309. That is, this waveform may correspond to a waveform of a half cycle of the alternating-current signal Sac2. The resistor 363 and the capacitor 364 may function as an RC filter, and may perform smoothing of this waveform to generate the signal A2. The PWM signal generation circuit 368 may generate the PWM signal B2 having the duty ratio according to the voltage of the signal A2. Then, the circuit 380 may generate the PWM signal PWMF, based on the PWM signal B2. The control circuit 390 may obtain the output voltage value Vout, based on the PWM signal PWMF.

In this way, the control circuit 390 may obtain the input current value Iin, the input voltage value Vin, and the output voltage value Vout. Based on these, the control circuit 390 may control an operation of the DC-AC converter 62, as described later.

In one embodiment of the invention, the low-voltage power supply section 60 corresponds to a specific but non-limiting example of a "power supply unit". The control circuit 390 corresponds to a specific but non-limiting example of a "controller" in one embodiment of the invention. The AC switches 410 and 420 correspond to a specific but non-limiting example of a "plurality of switches" in one embodiment of the invention. The zero-cross detection circuit 200 corresponds to a specific but non-limiting example of a "synchronizing signal generator" in one embodiment of the invention. The switching circuit 310 corresponds to a specific but non-limiting example of a "first switching circuit" in one embodiment of the invention. The switching circuit 320 corresponds to a specific but non-limiting example of a "second switching circuit" in one embodiment of the invention. The alternating-current signal Sac2 corresponds to a specific but non-limiting example of a "first alternating-current signal" in one embodiment of the invention. The alternating-current signal Sac1 corresponds to a specific but non-limiting example of a "second alternating-current signal" in one embodiment of the invention. The zero-cross signal SZ corresponds to a specific but non-limiting example of a "synchronizing signal" in one embodiment of the invention. The PWM signals PWMA and PWMB correspond to a specific but non-limiting example of a "pulse signal" in one embodiment of the invention.

Operation and Action

In the following, a description is given of an operation and action of the image forming apparatus 1 according to this example embodiment.

Outline of Overall Operation

First, a description is given with reference to FIGS. 1 to 3 of an outline of an overall operation of the image forming apparatus 1. In the image forming apparatus 1, upon receiving the printing data from, for example, an unillustrated host computer through the interface section 51, the printer engine control section 59 may first control the image processing section 52 to generate the bitmap data, based on the printing data. The printer engine control section 59 may further control the low-voltage power supply section 60 to supply the heaters 42A and 42B in the fixing section 40 with the electric power. The printer engine control section 59 may initiate a printing operation when a temperature of the fixing section 40 detected by the thermistor 44 reaches a temperature suitable for a fixing operation.

In the printing operation, the printer engine control section 59 may first control the hopping motor 11T to rotate the hopping roller 11 and control the resist motor 12T to rotate the resist roller 12. This causes the recording medium 9 to be conveyed along the conveying path 10.

Further, the printer engine control section 59 may control the drum motor 20T to rotate the photosensitive drum 21, the developing roller 24, and the feeding roller 26 in each of the developing sections 20C, 20M, 20Y, and 20K, and may control the belt motor 33T to rotate the drive roller 33. The printer engine control section 59 may control the high-voltage power supply section 55 to generate the various voltages, based on a result of the detection obtained from the medium sensor 13. The printer engine control section 59 may control an operation of the exposure control section 53 to operate each of the exposure heads 16C, 16M, 16Y, and 16K. This causes the electrostatic latent image to be formed first on the surface of the photosensitive drum 21 in each of the developing sections 20, and then causes the toner images to be formed based on those respective electrostatic latent images. The toner images formed on the respective photosensitive drums 21 of the developing sections 20 may be transferred onto a transfer surface of the recording medium 9.

Further, the printer engine control section 59 may control the heater motor 40T to rotate the heat roller 41 and the pressure-applying roller 43. This causes the toner on the recording medium 9 to be heated, melted, and pressurized in the fixing section 40. As a result, the toner images may be fixed to the recording medium 9.

Detailed Operation of Low-Voltage Power Supply Section 60

As illustrated in FIGS. 5 to 7, the alternating-current signal Sac1, which may be supplied from the commercial power supply 99, may be supplied to the power factor correction circuit 100 and the zero-cross detection circuit 200 through the fuse 91 and the common mode coil 92.

In the power factor correction circuit 100 as illustrated in FIG. 5, the bridge diode 101 may perform the full-wave rectification on the signal outputted from the common mode coil 92. The control circuit 140 may supply the switching circuit 110 and the switching circuit 120 with the gate drive signal GD1 and the gate drive signal GD2, respectively, to thereby control the switching operation performed in each of the switching circuits 110 and 120. The switching circuits 110 and 120 each may perform the switching operation on a signal rectified by the bridge diode 101.

Also, the diodes 131 and 132 each may perform the full-wave rectification on the signal outputted from the common mode coil 92. The signal having been subjected to the full-wave rectification may then be subjected to voltage-division by the resistors 136 and 137 to be supplied as the signal ACIN to the control circuit 140. The control circuit 140 may so control, based on the signal ACIN, the switching operation performed in each of the switching circuits 110 and 120 as to allow the power factor to be close to one.

This results in generation of a boosted signal at each of the second end of the inductor 111 in the switching circuit 110 and the second end of the inductor 121 in the switching circuit 120. The diodes 102 and 103 and the electrolytic capacitor 104 may perform smoothing of each of those signals to generate the signal Sdc390. The signal Sdc390 may be subjected to voltage division by the resistors 107 and 108 to be supplied as the signal FB to the control circuit 140. The control circuit 140 may vary, based on the signal FB, the switching duty ratio of each of the gate drive signals GD1 and GD2 to so control the voltage of the signal Sdc390 as to be a desired voltage (which can be 390 V although it is not limited thereto). In this manner, the power factor correction circuit 100 may generate the signal Sdc390.

In the zero-cross detection circuit 200 as illustrated in FIG. 7, the bridge diode 204 may perform the full-wave rectification on the signal between the second end of the resistor 202 and the second end of the capacitor 203. The zero-cross detection circuit 200 may generate the zero-cross signal SZ, based on a signal rectified by the bridge diode 204. The zero-cross signal SZ may include pulses generated for each of the zero-cross timings of the alternating-current signal Sac1.

In the DC-AC inverter 62 as illustrated in FIG. 8, the control circuit 390 may supply the switching circuits 310, 320, 330, and 340 with their respective PWM signals PWMA, PWMB, PWMC, and PWMD to control the switching operation in the switching section 300. Upon controlling the switching operation, the control circuit 390 may read out, from the duty ratio tables 391A and 391B, the switching duty ratio that is associated with the switching cycle that corresponds to the value of the counter 392, and may generate the PWM signals PWMA, PWMB, PWMC, and PWMD, based on the read out switching duty ratios. The switching section 300 may perform the switching operation on the signal Sdc390. The inductor 301 and the capacitor 302 may function as an LC filter, and thus remove, from the received signal, a high-frequency component resulting from the switching operation to generate the alternating-current signal Sac2.

The control circuit 390 may control the electric power supply to the heaters 42A and 42B, based on the heater control signals HA and HB. In one specific but non-limiting example, when the heater control signal HA is enabled, the control circuit 390 may enable the switch control signal SWA. This causes the alternating-current signal Sac2 generated by the switching section 300 to be supplied to the heater 42A through the AC switch 410. Similarly, when the heater control signal HB is enabled, the control circuit 390 may enable the switch control signal SWB. This causes the alternating-current signal Sac2 generated by the switching section 300 to be supplied to the heater 42B through the AC switch 420.

Initial Operation

The DC-AC inverter 62 may perform, prior to the electric power supply to the heaters 42A and 42B, an initial operation to confirm whether or not the heaters 42A and 42B operate normally. In the following, a description is given in detail on the initial operation.

Figure 19:
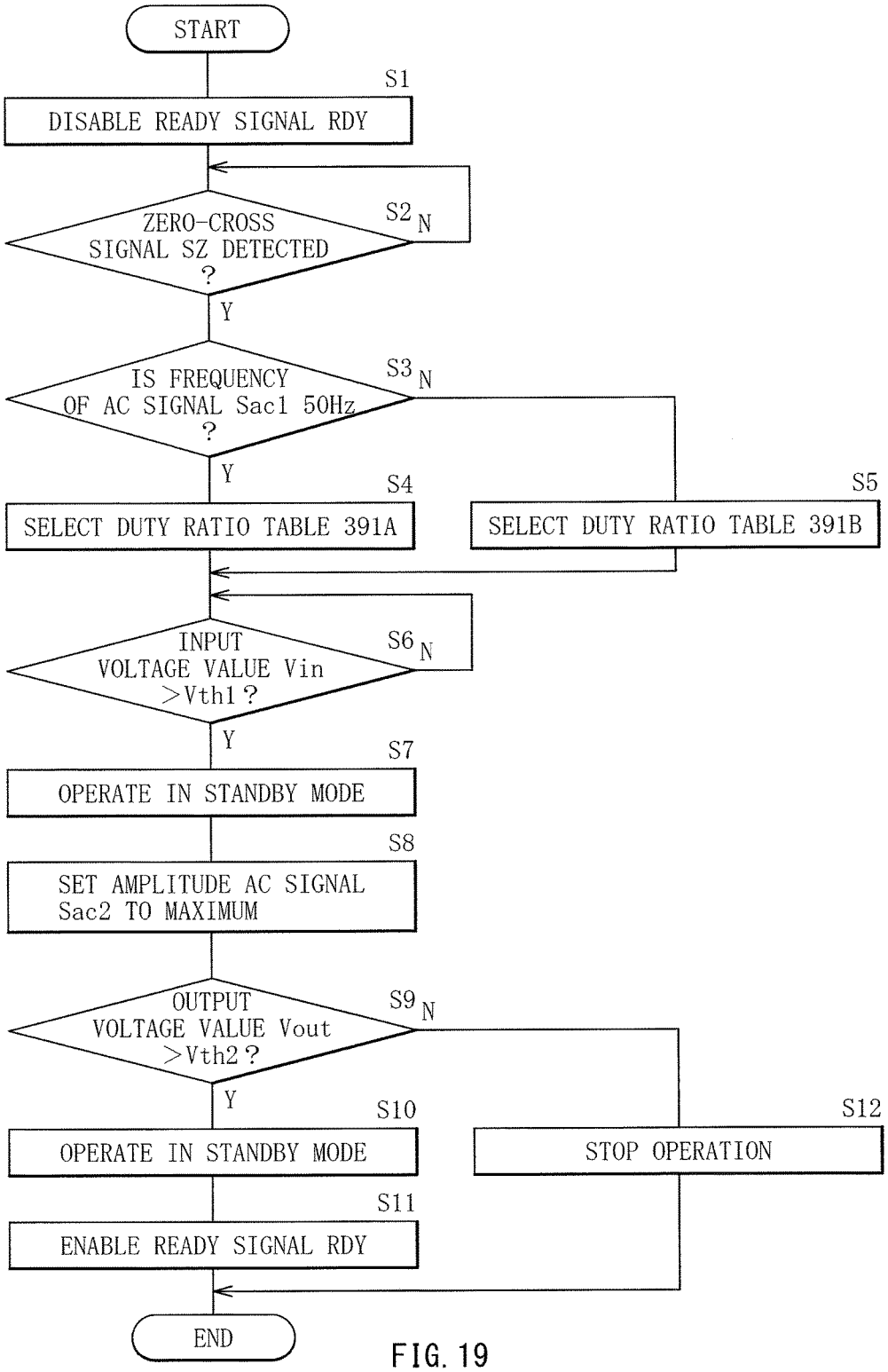
FIG. 19 is a flowchart illustrating an example of an operation of the control circuit illustrated in FIG. 8.

FIG. 19 illustrates an example of the initial operation. In the initial operation, the DC-AC inverter 62 may set the amplitude of the alternating-current signal Sac2 to a maximum while keeping the AC switches 410 and 420 turned off. After confirming that the amplitude of the alternating-current signal Sac2 is a desired amplitude, the DC-AC inverter 62 may enable the ready signal RDY. A detailed description is given in the following.

First, the control circuit 390 of the DC-AC inverter 62 may disable the ready signal RDY (step S1). In the flow as described below, when the ready signal RDY is kept disabled for predetermined time, the printer engine control section 59 may allow the display section 54 to provide indication of an error.

Next, the control circuit 390 may confirm whether or not the zero-cross signal SZ is supplied, by detecting the zero-cross signal SZ (step S2). When the zero-cross signal SZ is not detected ("N" in step S2), the flow may return to step S2, and may repeat step S2 until the zero-cross signal SZ is detected. When this repetitive operation causes the ready signal RDY to be kept disabled for the predetermined time, the printer engine control section 59 may allow the display section 54 to provide the indication of an error.

In step S2, when the zero-cross signal SZ is detected ("Y" in step S2), the control circuit 390 may confirm the frequency of the alternating-current signal Sac1, base on the zero-cross signal SZ (step S3). When the frequency of the alternating-current signal Sac1 is 50 Hz ("Y" in step S3), the control circuit 390 may select the duty ratio table 391A (step S4). Meanwhile, when the frequency of the alternating-current signal Sac1 is not 50 Hz ("N" in step S3), the control circuit 390 may select the duty ratio table 391B (step S5). Specifically, in this case, since the frequency of the alternating-current signal Sac1 is 60 Hz, the control circuit 390 may select the duty ratio table 391B.

Next, the control circuit 390 may confirm whether or not the input voltage value Vin is higher than a predetermined threshold value Vth1 (Vin>Vth1) (step S6). The threshold value Vth1 may be set to, for example but not limited to, 370 V. When the input voltage value Vin is equal to or lower than the predetermined threshold value Vth1 ("N" in step S6), the flow may return to step S6, and may repeat step S6 until the input voltage value Vin becomes higher than the predetermined threshold value Vth1. When this repetitive operation causes the ready signal RDY to be kept disabled for predetermined time, the printer engine control section 59 may allow the display section 54 to provide the indication of an error.

In step S6, when it is detected that the input voltage value Vin is higher than the predetermined threshold value Vth1 ("Y" in step S6), the control circuit 390 may allow the switching section 300 to operate in the standby mode (step S7), as illustrated in FIG. 16.

Next, the control circuit 390 may set the amplitude of the alternating-current signal Sac2 to the maximum (step S8). In one specific but non-limiting example, when the duty ratio table 391A is selected in step S4, the control circuit 390 may select the table 391A13 out of the thirteen tables 391A1 to 391A13 included in the duty ratio table 391A, and may generate the PWM signals PWMA and PWMB, based on the table 391A13. Meanwhile, when the duty ratio table 391B is selected in step S5, the control circuit 390 may select the table 391B13 out of the thirteen tables 391B1 to 391B13 included in the duty ratio table 391B, and may generate the PWM signals PWMA and PWMB, based on the table 391B13. In this way, the amplitude of the alternating-current signal Sac2 becomes about 90% (351 Vp) of the voltage of the signal Sdc390 (390 V in this example). At this occasion, the effective value of the alternating-current signal Sac2 may be about 249 Vrms.

Next, the control circuit 390 may confirm whether or not the output voltage value Vout is higher than a predetermined threshold value Vth2 (Vout>Vth2) (step S9). The threshold value Vth2 may be, for example, the effective value of the alternating-current signal Sac2 in the case in which the signal Sdc390 is the threshold value Vth1. In one specific but non-limiting example, the threshold value Vth2 may be 230 Vrms without limitation.

In step S9, when the output voltage value Vout is higher than the predetermined threshold value Vth2 ("Y" in step S9), the control circuit 390 may allow the switching section 300 to operate in the standby mode (step S10), as illustrated in FIG. 16. Then, the control circuit 390 may enable the ready signal RDY (step S11).

In step S9, when the output voltage value Vout is equal to or lower than the predetermined threshold value Vth2 ("N" in step S9), the control circuit 390 may stop operation of the switching section 300 (step S12). In one specific but non-limiting example, the control circuit 390 may set all the PWM signals PWMA, PWMB, PWMC, and PWMD to the low level to stop the operation of the switching section 300. Thereafter, the ready signal RDY may be kept disabled for predetermined time, causing the printer engine control section 59 to allow the display section 54 to provide the indication of an error.

This completes the flow.

In this way, the DC-AC inverter 62 may perform the initial operation, may confirm that the DC-AC inverter 62 operates normally, and may enable the ready signal RDY. Thereafter, the DC-AC inverter 62 may perform the electric power supply to the heaters 42A and 42B, based on the heater control signals HA and HB.

Slow-Up Control

Figure 20:
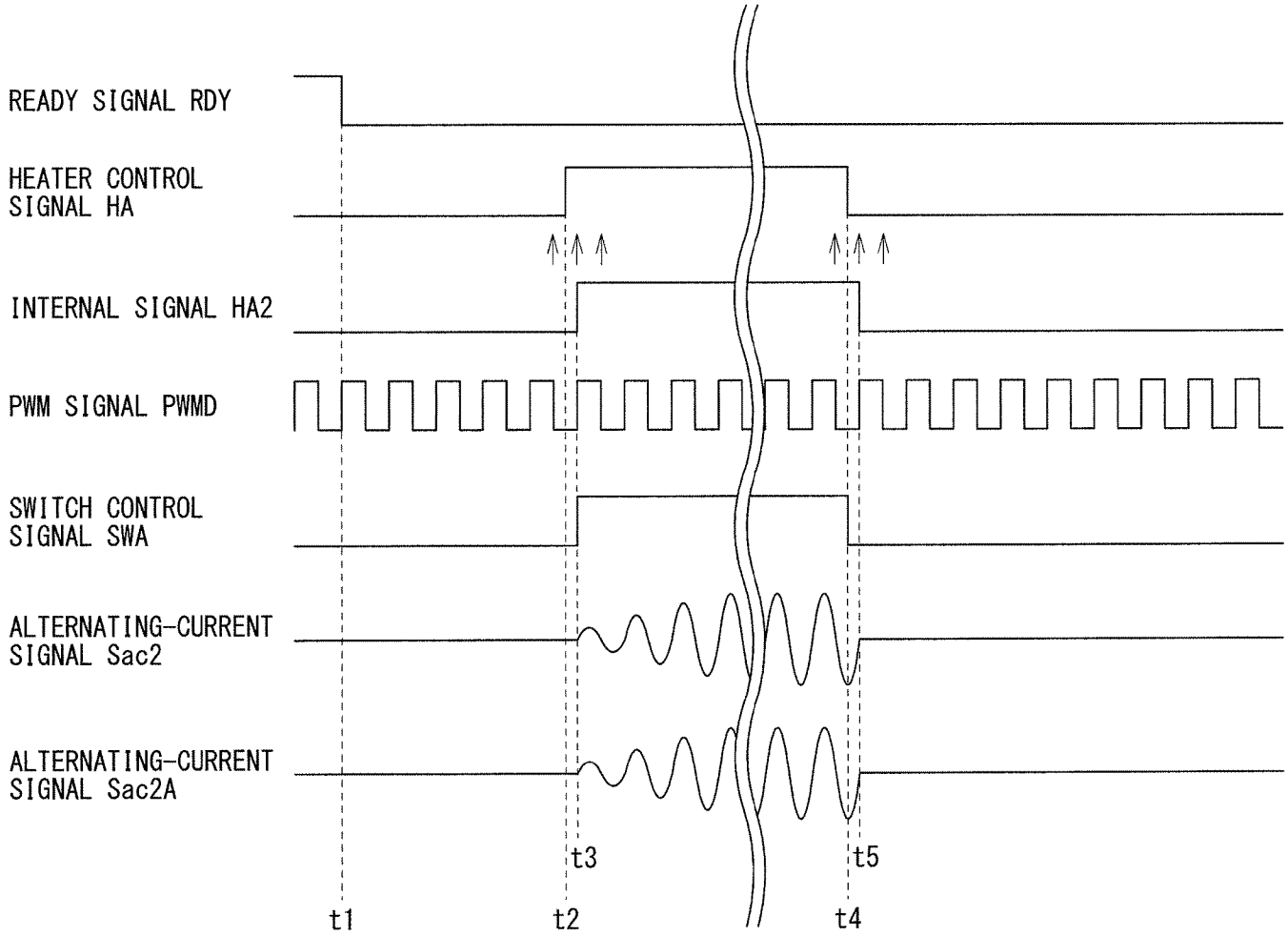
FIG. 20 is another timing waveform chart illustrating an example of an operation of the DC-AC inverter illustrated in FIG. 4.

FIG. 20 illustrates an example of an operation of the DC-AC inverter 62. In this example embodiment, the ready signal RDY may be a low-enabled signal, and the heater control signals HA and HB may be high-enabled signals.

The control circuit 390 may change, at a timing t1, the ready signal RDY from a high level to a low level (i.e., enable the ready signal RDY). Thereafter, the printer engine control section 59 may change, at a timing t2, the heater control signal HA from a low level to a high level (i.e., enable the heater control signal HA). It is to be noted that, although not illustrated, the heater control signal HB may be kept at a low level. The control circuit 390 may change, based on the heater control signal HA, at the timing t2, the switch control signal SWA from a low level to a high level. The control circuit 390 may generate an internal signal HA2 by sampling the heater control signal HA at a transition timing of the PWM signal PWMD, and may generate an internal signal HB2 by sampling the heater control signal HB at the transition timing of the PWM signal PWMD. In this example embodiment, the internal signal HA2 may be changed from a low level to a high level at a timing t3. Based on the internal signal HA2, the control circuit 390 may generate the PWM signals PWMA and PWMB with use of, for example, the duty ratio table 391A. This causes the switching section 300 to start the generation of the alternating-current signal Sac2. At this occasion, the control circuit 390 may perform the so-called slow-up control. Specifically, if the electrification to the heaters 42A and 42B is started while the heaters 42A and 42B are still cold, a rush current may become large because of the low resistance values of the heaters 42A and 42B. The control circuit 390 may therefore first set the amount of the electric power supply to the low level. When the heaters 42A and 42B are heated enough to lower the current, the control circuit 390 may increase the amount of the electric power supply. In this way, the control circuit 390 may gradually increase the amount of the electric power supply to the heaters 42A and 42B. This slow-up control may allow the amplitude of the alternating-current signal Sac2 to increase gradually. The AC switch 410 may become conductive at the zero-cross timing of the alternating-current signal Sac2, which allows the heater 42A to be supplied with the alternating-current signal Sac2.

Thereafter, the printer engine control section 59 may change, at a timing t4, the heater control signal HA from the high level to the low level (i.e., disable the heater control signal HA). Based on the heater control signal HA, the control circuit 390 may change, at the timing t4, the switch control signal SWA from the high level to the low level. In response thereto, the internal signal HA2 may change from the high level to the low level at a timing t5. Based on the internal signal HA2, the control circuit 390 may allow the switching section 300 to operate in the standby mode. Thereby, the switching section 300 may stop the generation of the alternating-current signal Sac2.

As described above, the control circuit 390 may control the operation of the DC-AC inverter 62, based on the heater control signals HA and HB. At this occasion, the control circuit 390 may determine whether or not to perform the slow-up control, in response to a change in the heater control signals HA and HB, as described below.

FIG. 21 summarizes operations of the control circuit 390 associated with each change in the heater control signals HA and HB. Here, "L" denotes the low level, and "H" denotes the high level. "Stop" denotes a control to stop the generation of the alternating-current signal Sac2, and "Maintain" denotes a control to continue the generation of the alternating-current signal Sac2.

The control circuit 390 may perform the slow-up control when a previous value is at the low level and a current value is at the high level, as to one or both of the heater control signals HA and HB. In this case, the electric power supply may be started to one or both of the heaters 42A and 42B. The control circuit 390 may therefore perform the slow-up control to restrain a rush current.

The control circuit 390 may perform the control to continue the generation of the alternating-current signal Sac2 when the previous value and the current value are both at the high level, as to one or both of the heater control signals HA and HB.

The control circuit 390 may perform the control to stop the generation of the alternating-current signal Sac2 when the current values of the heater control signals HA and HB are both at the low level. In one specific but non-limiting example, the control circuit 390 may allow the switching section 300 to operate in the standby mode, as illustrated in FIG. 16.

Figure 22:
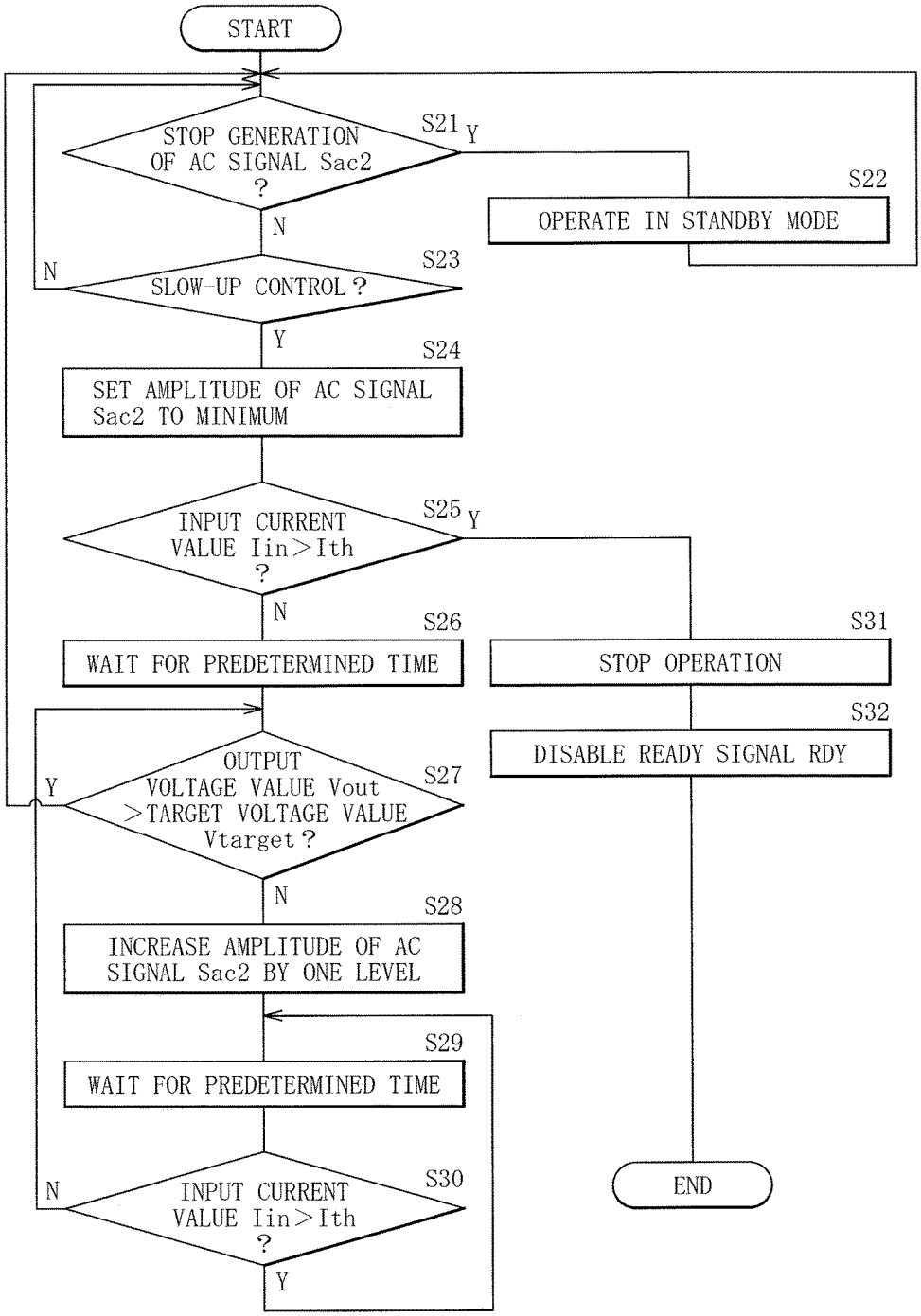
FIG. 22 is a flowchart illustrating an example of an operation of the control circuit illustrated in FIG. 8.

FIG. 22 illustrates an operation of the control circuit 390 based on the heater control signals HA and HB.

First, the control circuit 390 may determine, based on the heater control signals HA and HB, an operation that the control circuit 390 ought to perform, as illustrated in FIG. 21. When the control circuit 390 ought to perform the control to stop the generation of the alternating-current signal Sac2 ("Y" in step S21), the control circuit 390 may allow the switching section 300 to operate in the standby mode (step S22), as illustrated in FIG. 16. Then, the flow may return to step S21. Otherwise ("N" in step S21), when the control circuit 390 ought to perform the slow-up control ("Y" in step S23), the flow may proceed to step S24. Otherwise ("N" in step S23), the flow may return to step S21, which means that the control circuit 390 ought to perform the control to continue the generation of the alternating-current signal Sac2.

Next, the control circuit 390 may set the amplitude of the alternating-current signal Sac2 to a minimum (step S24). In one specific but non-limiting example, when the control circuit 390 has selected the duty ratio table 391A in step S4 of the initial operation (see FIG. 19), the control circuit 390 may select the table 391A1 out of the thirteen tables 391A1 to 391A13 included in the duty ratio table 391A, and may generate the PWM signals PWMA and PWMB, based on the table 391A1. Meanwhile, when the control circuit 390 has selected the duty ratio table 391B in step S5 of the initial operation (see FIG. 19), the control circuit 390 may select the table 391B1 out of the thirteen tables 391B1 to 391B13 included in the duty ratio table 391B, and may generate the PWM signals PWMA and PWMB, based on the table 391B1. In this way, the amplitude of the alternating-current signal Sac2 becomes about 30% (117 Vp) of the voltage of the signal Sdc390 (390 V in this example). At this occasion, the effective value of the alternating-current signal Sac2 may be about 83 Vrms.

Next, the control circuit 390 may confirm whether or not the input current value Iin is larger than a predetermined threshold value Ith (Iin>Ith) (step S25).

In step S25, when the input current value Iin is larger than the predetermined threshold value Ith ("Y" in step S25), the control circuit 390 determines that the DC-AC inverter 62 is in an abnormal state. Then, the control circuit 390 may stop the operation of the switching section 300 (step S31). In one specific but non-limiting example, the control circuit 390 may stop the operation of the switching section 300 by, for example, allowing all the PWM signals PWMA, PWMB, PWMC, and PWMD to be at the low level. The control circuit 390 may also allow the switch control signals SWA and SWB to be at the low level. Then, the control circuit 390 may disable the ready signal RDY (step S32).

In step S25, when the input current value Iin is equal to or smaller than the predetermined threshold value Ith ("N" in step S25), the control circuit 390 may confirm, after a lapse of predetermined time (step S26), whether or not the output voltage value Vout is larger than a target voltage value Vtarget (Vout>Vtarget) (step S27). The target voltage value Vtarget may be a target value of the output voltage value Vout in supplying the electric power to the heaters 42A and 42B, and may be prescribed in advance in the control circuit 390. When the output voltage value Vout is larger than the target voltage value Vtarget ("Y" in step S27), the flow may return to step S21. Specifically, in this case, since the output voltage value Vout has reached the target voltage value Vtarget, the control circuit 390 may terminate the slow-up control.

In step S27, when the output voltage value Vout is equal to or smaller than the target voltage value Vtarget ("N" in step S27), the control circuit 390 may increase the amplitude of the alternating-current signal Sac2 by one level (step S28). In one specific but non-limiting example, when the control circuit 390 has selected the table 391A1, the control circuit 390 may select the table 391A2 instead; when the control circuit 390 has selected the table 391A2, the control circuit 390 may select the table 391A3 instead. The same applies to the other tables. This causes the amplitude of the alternating-current signal Sac2 to be increased by 5%.

Then, after a lapse of predetermined time (e.g., 60 microseconds) (step S29), the control circuit 390 may confirm whether or not the input current value Iin is larger than the predetermined threshold value Ith (Iin>Ith) (step S30). When the input current value Iin is larger than the predetermined threshold value Ith ("Y" in step S30), the flow may return to step S29, and may repeat steps S29 and S30 until the input current value Iin becomes equal to or smaller than the predetermined threshold value Ith. Specifically, immediately after a change in the amount of the electric power supply, the heaters 42A and 42B are not sufficiently heated, and their resistance values are low, which results in a large rush current. The control circuit 390 may therefore operate to wait for the heaters 42A and 42B to be heated enough to lower a current.

In step S30, the input current value Iin is equal to or smaller than the predetermined threshold value Ith ("N" in step S30), the flow may return to step S27, and may repeat steps S27 to S30 until the output voltage value Vout reaches the target voltage value Vtarget.

Figure 23:
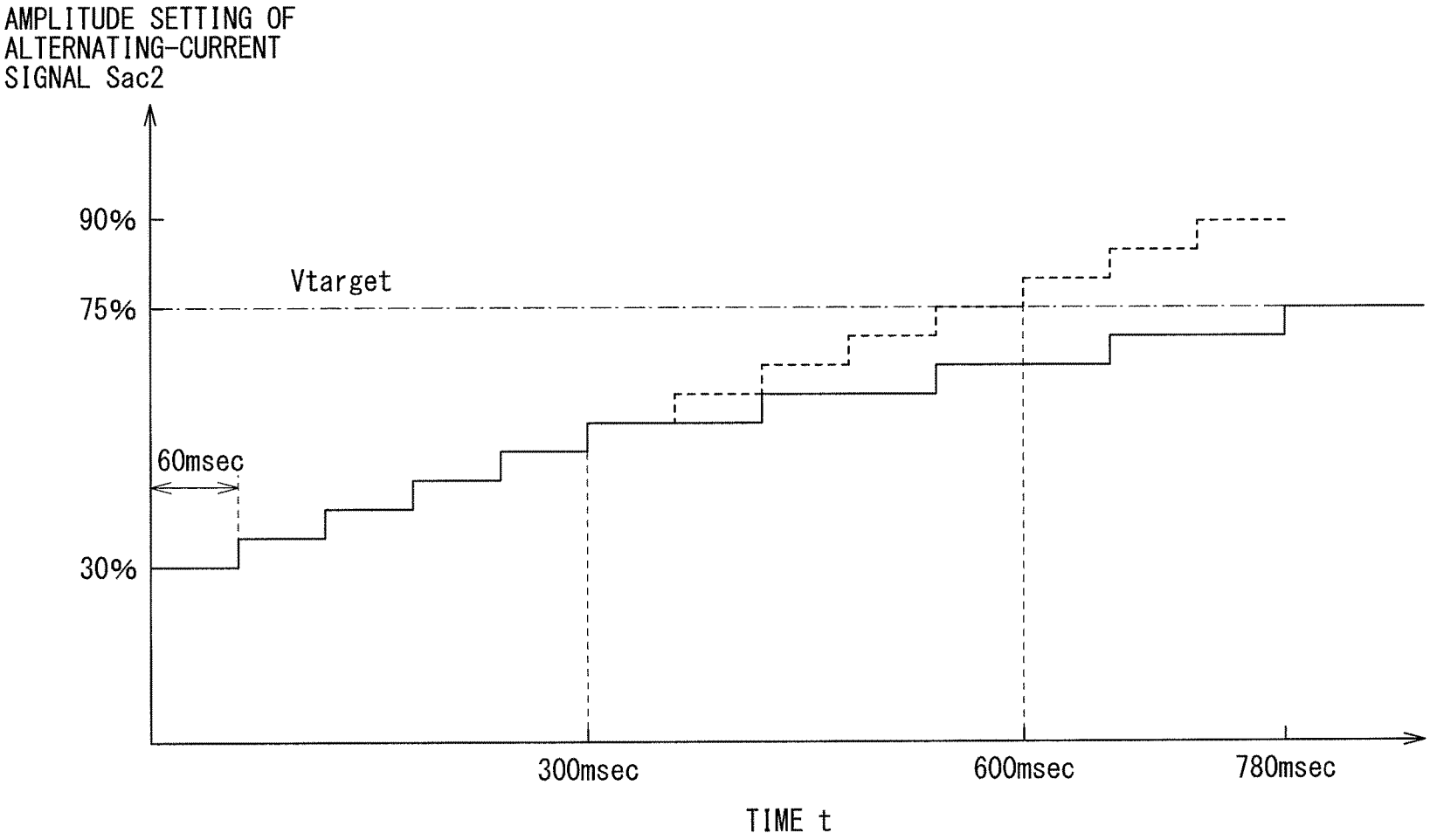
FIG. 23 illustrates an example of an operation of the control circuit illustrated in FIG. 8.

FIG. 23 illustrates the slow-up control. In this example embodiment, the setting of the amplitude of the alternating-current signal Sac2 may be gradually changed from 30% to 75% (the target voltage value Vtarget) of the voltage of the signal Sdc390. At this occasion, the control circuit 390 may gradually increase the amplitude of the alternating-current signal Sac2 by comparing the input current value Iin and the predetermined threshold value Ith in a cycle of 60 microseconds.

In this example embodiment, until 300 microseconds, the control circuit 390 may increase the amplitude of the alternating-current signal Sac2 stepwise one by one. Specifically, in this example embodiment, until 300 microseconds, the input current value Iin is equal to or smaller than the predetermined threshold value Ith. The control circuit 390 may therefore increase the amplitude of the alternating-current signal Sac2 stepwise one by one. Then, at 360 microseconds, in this example embodiment, the input current value Iin is larger than the predetermined threshold value Ith. The control circuit 390 may therefore maintain the amplitude of the alternating-current signal Sac2. Next, at 420 microseconds, in this example embodiment, the input current value Iin is equal to or smaller than the predetermined threshold value Ith. The control circuit 390 may therefore increase the amplitude of the alternating-current signal Sac2 by one level. In other words, the control circuit 390 may change, based on the input current value Iin, an increase ratio of the amplitude of the alternating-current signal Sac2. In this way, the control circuit 390 may gradually increase the amplitude of the alternating-current signal Sac2. In this example embodiment, at 780 microseconds, the control circuit 390 may set the amplitude of the alternating-current signal Sac2 to 75% (the target voltage value Vtarget) of the voltage of the signal Sdc390.

Figure 24:
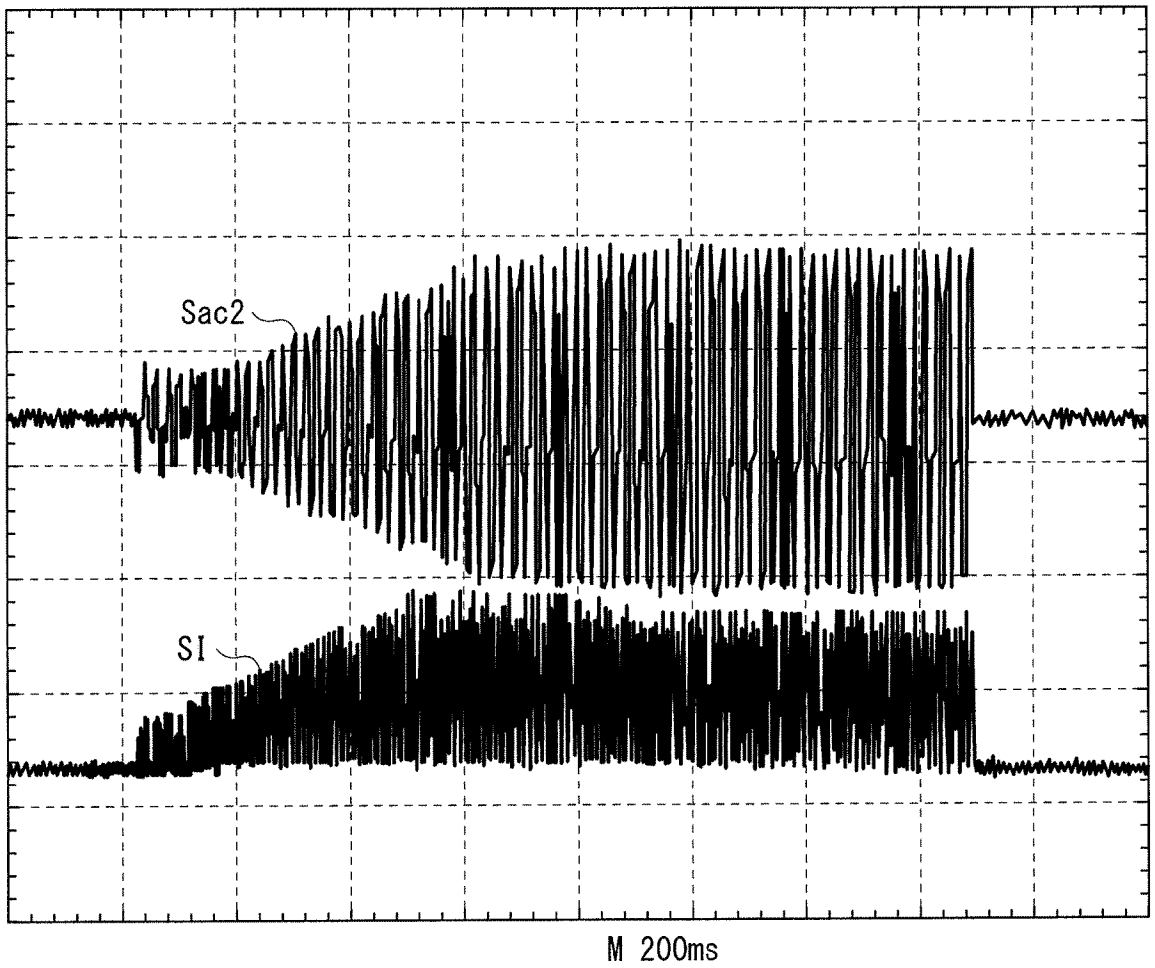
FIG. 24 is a waveform chart illustrating an example of an operation of the DC-AC inverter illustrated in FIG. 4.

FIG. 24 illustrates an example of a waveform of the alternating-current signal Sac2, and a waveform of the output signal SI of the current detection circuit 350. As illustrated, the DC-AC inverter 62 may gradually increase the amplitude of the alternating-current signal Sac2.

As described, in the DC-AC inverter 62, the amount of the electric power supply to the heaters 42A and 42B may be gradually increased. At this occasion, the control circuit 390 may monitor the input current value Iin, and may gradually increase the amplitude of the alternating-current signal Sac2, while keeping the input current value Iin from exceeding the predetermined threshold value Ith. Hence, in the DC-AC inverter 62, it is possible to restrain a rush current, resulting in reduction in a possibility of an occurrence of a conduction noise, a flicker, or both.

Moreover, in the DC-AC inverter 62, the output voltage value Vout may be detected. The amplitude of the alternating-current signal Sac2 may be controlled to allow the output voltage value Vout to reach the target voltage value Vtarget. Hence, it is possible to supply the heaters 42A and 42B with desired electric power, regardless of, for example, electric power loss in the IGBTs 311, 321, 341, and 342, and load variation of the power factor correction circuit 100.

Furthermore, in the low-voltage power supply section 60, the switching operation may be performed on the signal Sdc390 to generate the alternating-current signal Sac2. Hence, it is possible to eliminate the necessity to provide a fixing section for each of supply voltages of the commercial power supply 99. Specifically, for example, in a case with a configuration in which the alternating-current signal Sac1 supplied from the commercial power supply 99 is directly supplied to the heaters while a phase control is performed, it is necessary to provide a fixing section for each of supply voltages of the commercial power supply 99. Meanwhile, in the low-voltage power supply section 60, the switching operation may be performed on the signal Sdc390 to generate the alternating-current signal Sac2. Hence, it is possible to share a fixing section regardless of the supply voltages of the commercial power supply 99.

Example Effect

According to the foregoing example embodiment, the amplitude of the alternating-current signal Sac2 is gradually increased, making it possible to restrain a rush current. Hence, it is possible to reduce a possibility of an occurrence of a conduction noise, a flicker, or both.

Moreover, according to the foregoing example embodiment, the switching operation is performed on the signal Sdc390 to generate the alternating-current signal Sac2. Hence, it is possible to eliminate the necessity to provide a fixing section for each of supply voltages of the commercial power supply, and thereby to allow for sharing of the fixing section.

Modification Example 1

Figure 25:
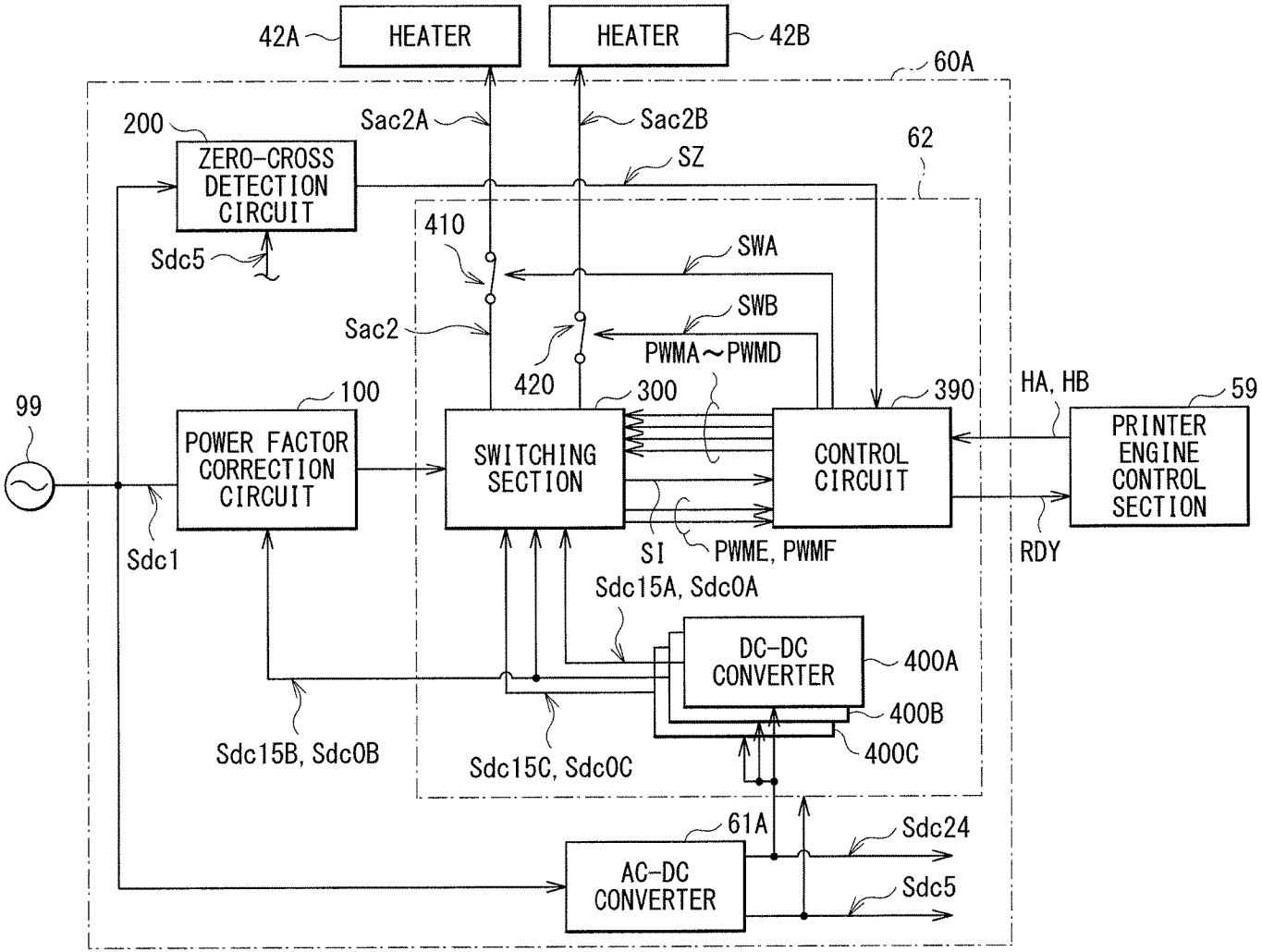
FIG. 25 is a block diagram illustrating an example of a configuration of a low-voltage power supply section according to a modification example.

In the foregoing example embodiment, as illustrated in FIG. 4, the DC-DC converter 61 generates the signals Sdc24 and Sdc5, based on the signal Sdc390 outputted from the power factor correction circuit 100. However, this is illustrative and non-limiting. For example, the DC-DC converter 61 may receive the Sdc390 that has passed through the first winding of the current detection circuit 350 of the switching section 300 as illustrated in FIG. 8, and may generate the signals Sdc24 and Sdc5, based on the received signal Sdc390. Alternatively, for example, as in a low-voltage power supply section 60A as illustrated in FIG. 25, an AC-DC converter 61A may generate the signals Sdc24 and Sdc5, based on the alternating-current signal Sac1.

Modification Example 2

In the forgoing example embodiment, the printer engine control section 59 supplies the control circuit 390 of the DC-AC inverter 62 with the heater control signals HA and HB, and the control circuit 390 supplies the printer engine control section 59 with the ready signal RDY. However, this is illustrative and non-limiting. In the following, a description is given in detail of a modification example.

Figures 26, 27:
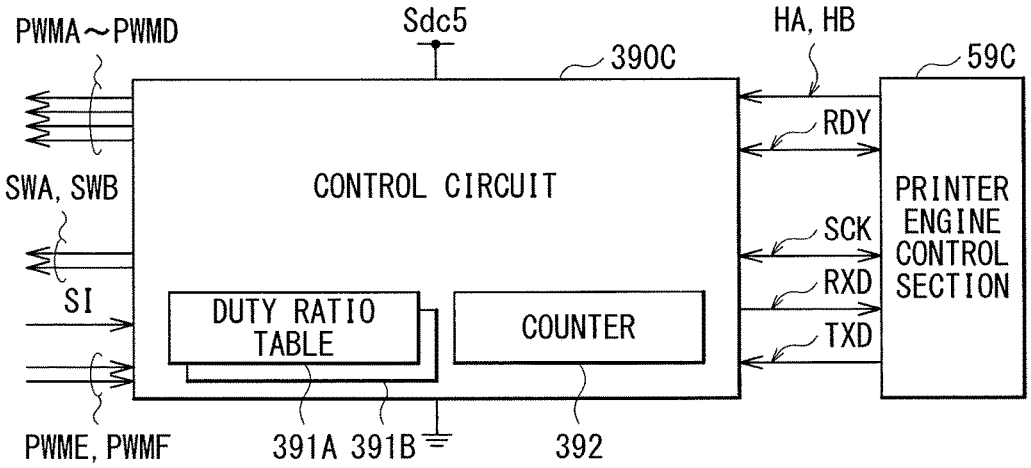
FIG. 26 is a block diagram illustrating an example of a configuration of a printer engine control section and a control circuit according to a modification example.
FIG. 27 is a table provided for description of a read command.

FIG. 26 illustrates an example of a configuration of a control circuit 390C and a printer engine control section 59C according to the modification example. In this example, the printer engine control section 59C may further supply the control circuit 390C with a clock signal SCK and a data signal TXD. The control circuit 390C may further supply the printer engine control section 59C with the data signal RXD. In one specific but non-limiting example, the printer engine control section 59C may supply the control circuit 390C with a one-byte read command, with use of the data signal TXD. The control circuit 390C may supply the printer engine control section 59C with one-byte data, with use of the data signal RXD. The printer engine control section 59C may also supply the control circuit 390C with a one-byte write command and one-byte data, with use of the data signal TXD.

FIG. 27 illustrates one example of the read command. The read command may include, for example, a status command, an input voltage command, an input current command, and an output voltage command.

The status command may be a command to obtain a status of the DC-AC inverter 62. The status of the DC-AC inverter 62 may include, for example, the initial operation as illustrated in FIG. 19, and the standby mode as illustrated in FIG. 16. The status of the DC-AC inverter 62 may also include an off mode as described below.

Figure 28:
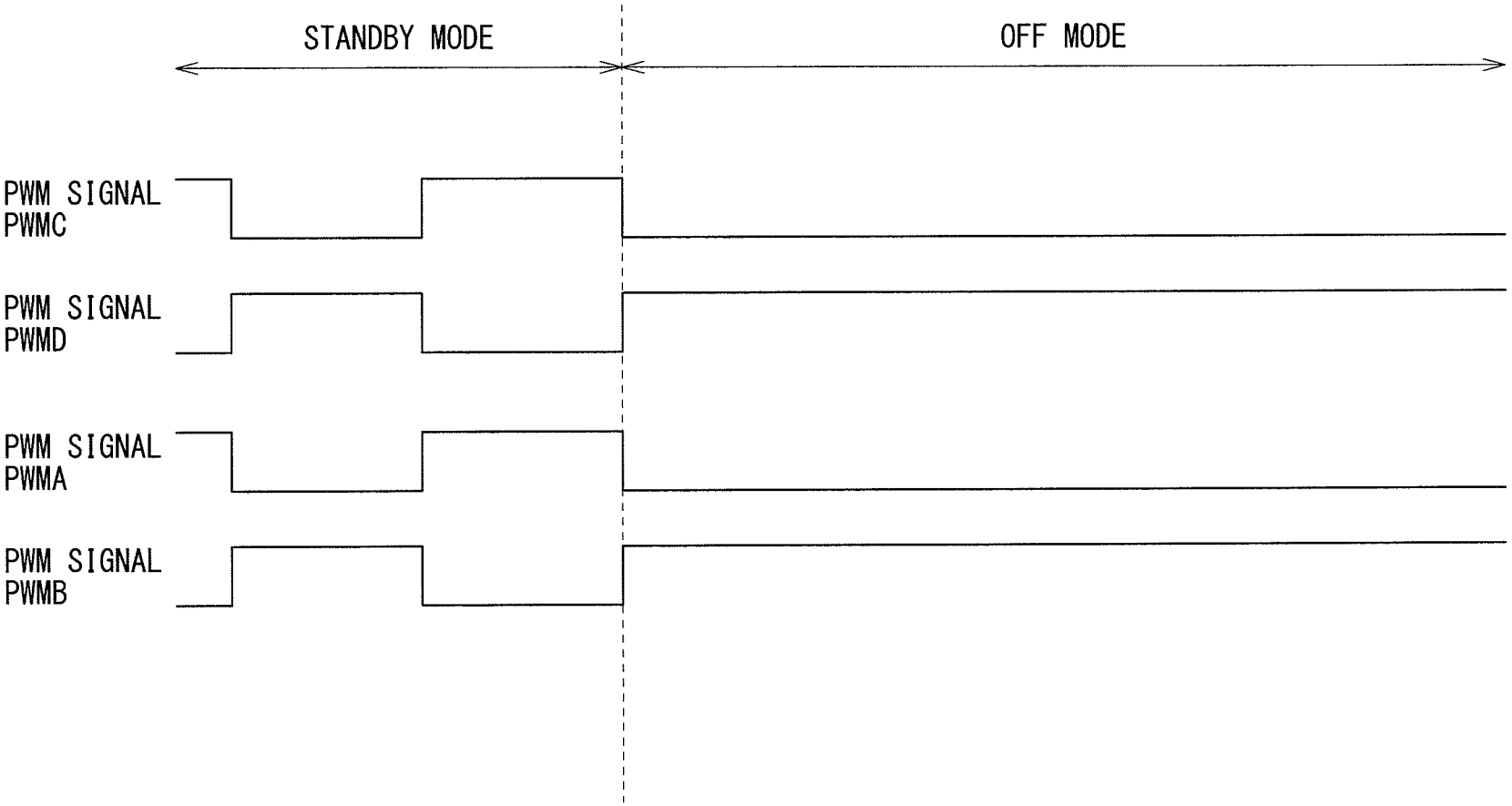
FIG. 28 is a waveform chart provided for description of a standby mode and an off mode.

FIG. 28 illustrates one example of a waveform of the PWM signals PWMA, PWMB, PWMC, and PWMD in the standby mode and the off mode. The waveform in the standby mode may be similar to that as illustrated in FIG. 16. Meanwhile, in the off mode, there is no transition of the PWM signals PWMA, PWMB, PWMC, and PWMD. In this example, the PWM signals PWMA and PWMC may be set to the low level, while the PWM signals PWMB and PWMD may be set to the high level. In this case, the switching section 300 does not generate any alternating-current signal Sac2. It is to be noted that this is illustrative and non-limiting. For example, the PWM signals PWMA and PWMC may be set to the high level, while the PWM signals PWMB and PWMD may be set to the low level. In another alternative, all the PWM signals PWMA, PWMB, PWMC, and PWMD may be set to the low level. In the off mode, it is possible to reduce power consumption, as compared to the standby mode.

The input voltage command may be a command to obtain a moving average value of the voltage value (the input voltage value Vin) of the signal Sdc390 inputted to the DC-AC inverter 62. The input current command may be a command to obtain a moving average value of the input current value Iin of the DC-AC inverter 62. The output voltage command may be a command to obtain a moving average value of the effective value (the output voltage value Vout) of the alternating-current signal Sac2 that the DC-AC inverter 62 generates.

FIG. 29 illustrates one example of the write command. The write command may include, for example, a current limit command, a target voltage command, a start voltage command, a control cycle command, an output standby command, and an output off command. The current limit command may be a command to set the threshold value Ith. The target voltage command may be a command to set the target voltage value Vtarget. The start voltage command may be a command to set a start voltage (the amplitude in step S24) in the slow-up control. The control cycle command may be a command to set a control cycle (the predetermined time in step S29) in the slow-up control. The output standby command may be a command to allow the DC-AC inverter 62 to operate in the standby mode. The output off command may be a command to allow the DC-AC inverter 62 to operate in the off mode.

Modification Example 3

In the forgoing example embodiment, the control circuit 390 generates the internal signals HA2 and HB2 by sampling the heater control signals HA and HB at the transition timing of the PWM signal PWMD. However, this is illustrative and non-limiting. In the following, a detailed description is given on a modification example.

Figure 30:
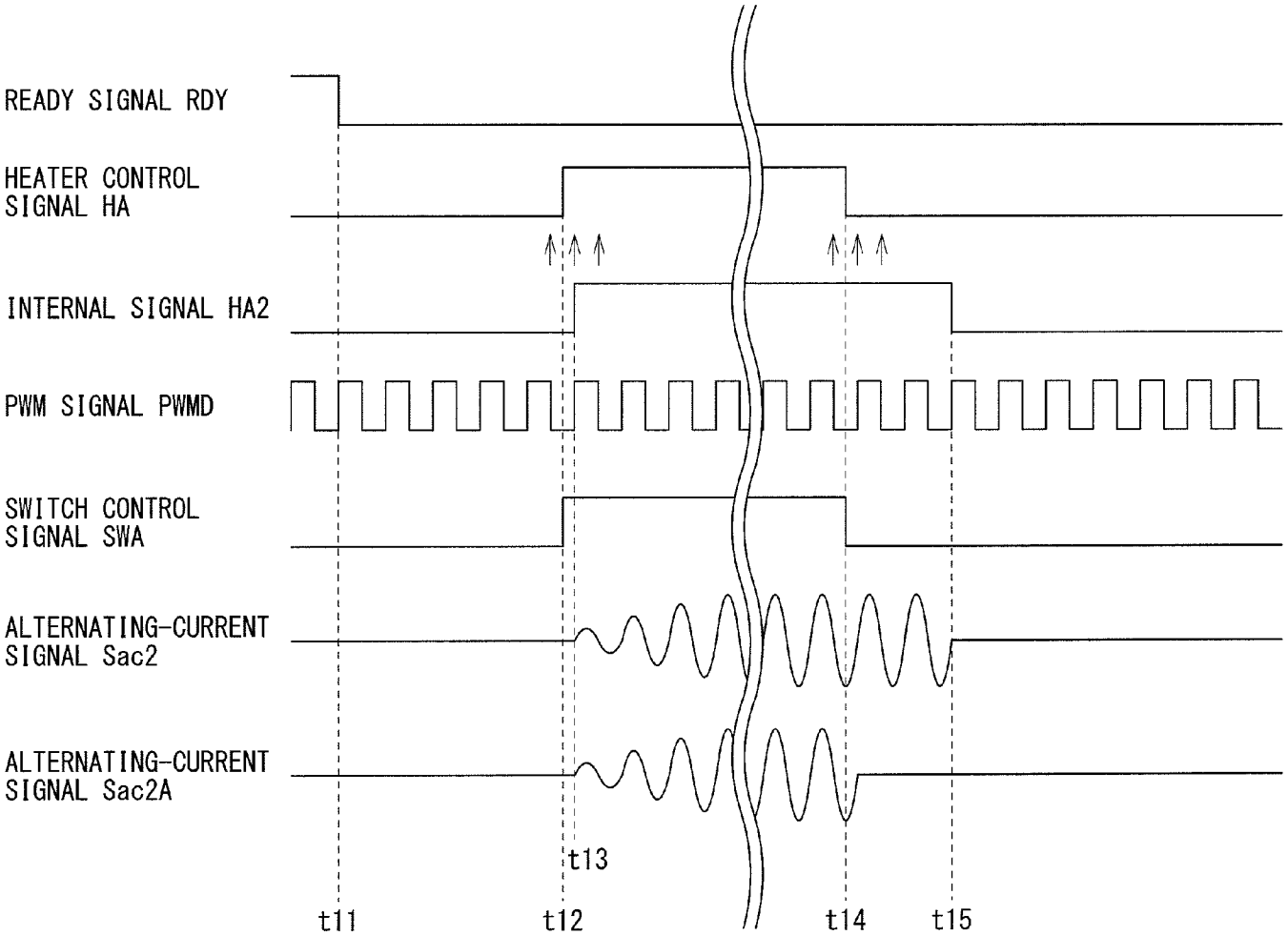
FIG. 30 is a timing waveform chart illustrating an example of an operation of a DC-AC inverter according to a modification example.

FIG. 30 illustrates an example of an operation of a DC-AC inverter 62D according to the modification example. FIG. 30 corresponds to FIG. 20 according to the forgoing example embodiment. A control circuit 390D according to the modification example may change the internal signals HA2 and HB2 from the low level to the high level, at the transition timing of the PWM signal PWMD immediately after the heater control signals HA and HB change from the low level to the high level. The control circuit 390D may change the internal signals HA2 and HB2 from the high level to the low level, at a timing after a lapse of time of two cycles of the PWM signal PWMD from the transition timing of the PWM signal PWMD immediately after the heater control signals HA and HB change from the high level to the low level. Then, the control circuit 390D may generate, based on the internal signals HA2 and HB2, the PWM signals PWMA and PWMB with use of, for example, the duty ratio table 391A. This allows the switching section 300 to generate the alternating-current signal Sac2.

Figure 31:
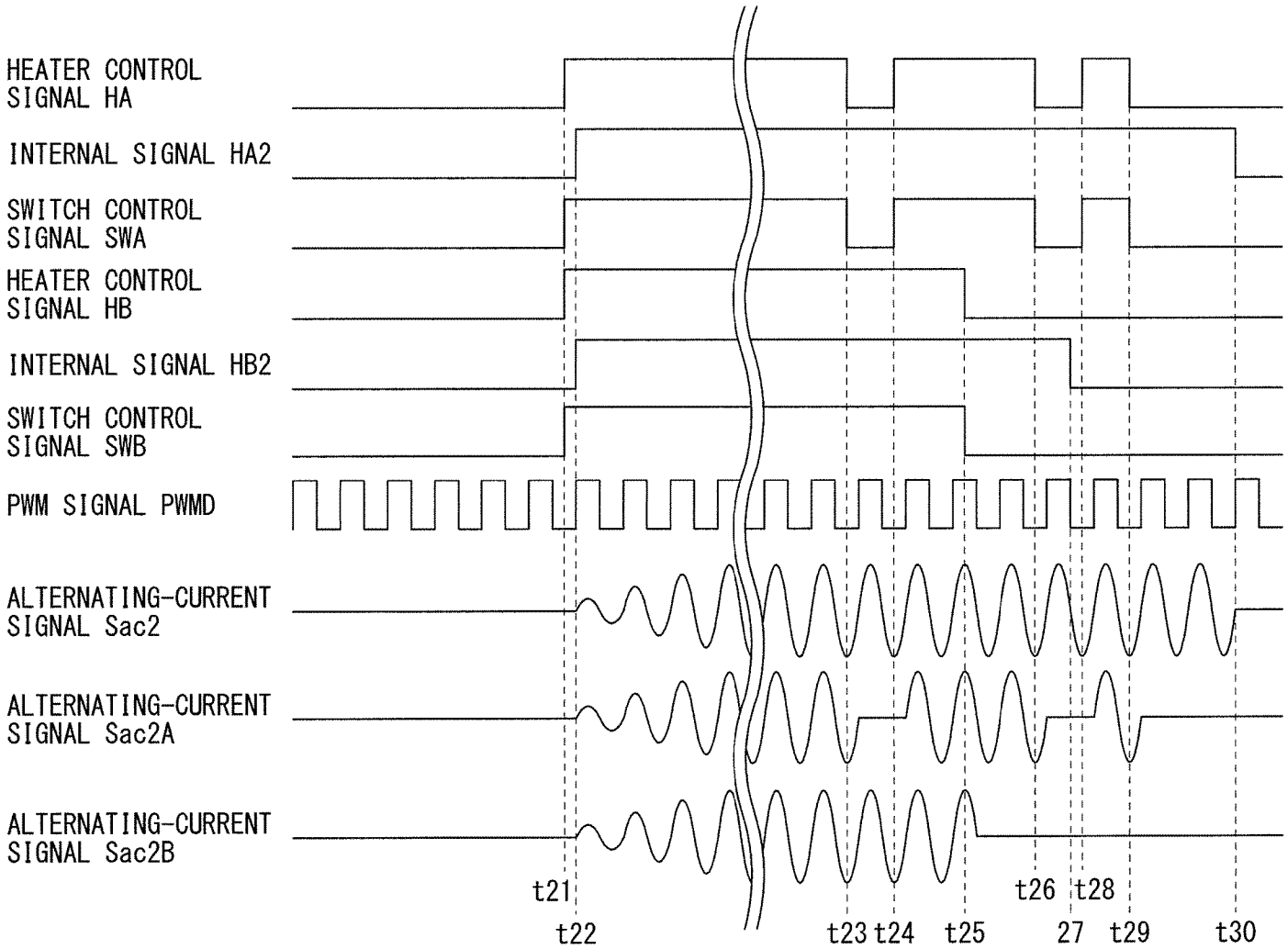
FIG. 31 is a timing waveform chart illustrating another example of an operation of the DC-AC inverter according to the modification example.

FIG. 31 illustrates another example of an operation of the DC-AC inverter 62D. The printer engine control section 59 may change, at a timing t21, the heater control signals HA and HB from the low level to the high level (i.e., enable the heater control signals HA and HB). At the timing t21, the control circuit 390D may change, based on the heater control signal HA, the switch control signal SWA from the low level to the high level, and may change, based on the heater control signal HB, the switch control signal SWB from the low level to the high level. At a timing t22, the control circuit 390D may change the internal signal HA2 from the low level to the high level, and may change the internal signal HB2 from the low level to the high level. Based on the internal signals HA2 and HB2, the control circuit 390D may generate the PWM signals PWMA and PWMB with use of, for example, the duty ratio table 391A. This allows the switching section 300 to generate the alternating-current signal Sac2 by performing the slow-up control.

Thereafter, at a timing t23, the printer engine control section 59 may change the heater control signal HA from the high level to the low level (i.e., disable the heater control signal HA). In response thereto, the control circuit 390D may change the switch control signal SWA from the high level to the low level. At a timing t24, the printer engine control section 59 may change the heater control signal HA from the low level to the high level (i.e., enable the heater control signal HA). In response thereto, the control circuit 390D may change the switch control signal SWA from the low level to the high level. In this way, the DC-AC inverter 62D may temporarily stop output of the alternating-current signal Sac2A. During this term, the internal signals HA2 and HB2 are both at the high level. The switching section 300 may therefore continue the generation of the alternating-current signal Sac2.

At a timing t25, the printer engine control section 59 may change the heater control signal HB from the high level to the low level (i.e., disable the heater control signal HB). In response thereto, the control circuit 390D may change the switch control signal SWB from the high level to the low level. This allows the DC-AC inverter 62D to stop output of the alternating-current signal Sac2B. Thereafter, at a timing t27, the control circuit 390D may change the internal signal HB2 from the high level to the low level. At this occasion, the internal signal HA2 is at the high level. The switching section 300 may therefore continue the generation of the alternating-current signal Sac2.

At a timing t26, the printer engine control section 59 may change the heater control signal HA from the high level to the low level (i.e., disable the heater control signal HA). In response thereto, the control circuit 390D may change the switch control signal SWA from the high level to the low level. At a timing t28, the printer engine control section 59 may change the heater control signal HA from the low level to the high level (i.e., enable the heater control signal HA). In response thereto, the control circuit 390D may change the switch control signal SWA from the low level to the high level. This allows the DC-AC inverter 62D to temporarily stop the output of the alternating-current signal Sac2A. During this term, the internal signal HA2 is at the high level. The switching section 300 may therefore continue the generation of the alternating-current signal Sac2.

At a timing t29, the printer engine control section 59 may change the heater control signal HA from the high level to the low level (i.e., disable the heater control signal HA). In response thereto, the control circuit 390D may change the switch control signal SWA from the high level to the low level. This allows the DC-AC inverter 62D to stop the output of the alternating-current signal Sac2A. At this occasion, the internal signal HA2 is at the high level. The switching section 300 may therefore continue the generation of the alternating-current signal Sac2. Thereafter, the control circuit 390D may change, at a timing t30, the internal signal HA2 from the high level to the low level. This allows the switching section 300 to stop the generation of the alternating-current signal Sac2.

As described above, in the DC-AC inverter 62D, even when the heater control signals HA and HB are changed to the low level, the internal signals HA2 and HB2 are not immediately changed to the low level. Hence, it is possible to keep the slow-up control from being immediately performed at, for example, the timing t24. Specifically, immediately after stop of the electric power supply to the heaters 42A and 42B, the heaters 42A and 42B are still hot. Accordingly, restart of the electric power supply to the heaters 42A and 42B is not likely to cause a large rush current. The DC-AC inverter 62D may therefore keep itself from performing the slow-up control in such a case.

Although the invention has been described in the foregoing by way of example with reference to the example embodiments and the modification examples, the invention is not limited thereto but may be modified in a wide variety of ways.

For example, although the example embodiments and the modification examples have been described with reference to a color printer, an application of an embodiment of the invention is not limited to the color printer. Any embodiment of the invention may be applied to a monochrome printer without limitation.

Further, although the example embodiments and the modification examples have been described with reference to a printer, an application of an embodiment of the invention is not limited to the printer. Any embodiment of the invention is applicable to a printer, a facsimile, a scanner, a Multi-Function Peripheral in which two or more of the printer, the facsimile, and the scanner are combined, or any other instrument that forms an image on a medium.

Furthermore, the invention encompasses any possible combination of some or all of the various embodiments and the modification examples described herein and incorporated herein.

It is possible to achieve at least the following configurations from the above-described example embodiments of the invention.

(1) A power supply unit, including:
- a switching section configured to perform a switching operation and thereby generate, based on an input signal, a first alternating-current signal; and
- a controller configured to control the switching operation and thereby perform an amplitude control that involves increasing, based on an input current in the switching section, a signal amplitude of the first alternating-current signal.

(2) The power supply unit according to (1), wherein the controller increases the signal amplitude by a predetermined amount, not to allow the input current to exceed a predetermined current value.

(3) The power supply unit according to (1) or (2), wherein the controller determines, based on the input current, a timing of increasing the signal amplitude.

(4) The power supply unit according to any one of (1) to (3), wherein the controller controls the switching operation, based on the first alternating-current signal.

(5) The power supply unit according to any one of (1) to (4), further including a plurality of switches that turn on and off supply of the first alternating-current signal to different loads from one another,
- wherein the controller performs the amplitude control when one or more of the plurality of switches are changed from an off state to an on state.

(6) The power supply unit according to any one of (1) to (5), further including a switch that turns on and off supply of the first alternating-current signal to a load, wherein the controller performs the amplitude control when the switch is changed from an on state to an off state, and is changed again to the on state after a lapse of predetermined time.

(7) The power supply unit according to any one of (1) to (6), further including a power factor correction circuit,
- wherein the input signal is a direct-current signal, and
- the power factor correction circuit generates the direct-current signal, based on a second alternating-current signal.

(8) The power supply unit according to (7), further including a synchronizing signal generator that generates a synchronizing signal in synchronization with the second alternating-current signal, wherein the controller controls, based on the synchronizing signal, the switching operation to allow a frequency of the first alternating-current signal to coincide with a frequency of the second alternating-current signal.

(9) The power supply unit according to (8), wherein the controller selectively generates, based on the synchronizing signal, one of a first pulse signal and a second pulse signal, the first pulse signal including a plurality of pulses and having a first time length, and the second pulse signal including a plurality of pulses and having a second time length, and the switching section performs the switching operation, based on a pulse signal selected from the first pulse signal and the second pulse signal.

(10) The power supply unit according to any one of (1) to (9), wherein the switching section includes a first switching circuit including a first terminal to which the input signal is supplied, and a second terminal, the first switching circuit turning on and off between the first terminal and the second terminal, and a second switching circuit, including a third terminal coupled to the second terminal of the first switching circuit, and a fourth terminal, the second switching circuit turning on and off between the third terminal and the fourth terminal, and the controller has a first mode and a second mode that involve controlling the switching section not to generate the first alternating-current signal, controls, in the first mode, the switching operation to turn off one or both of the first switching circuit and the second switching circuit, and fixes, in the second mode, one or both of the first switching circuit and the second switching circuit to an off state.

(11) The power supply unit according to any one of (1) to (10), wherein the switching section supplies the first alternating-current signal to a heater.

(12) An image forming apparatus, including:

a developing unit;

a fixing unit including a heater, and configured to fix a developer onto a recording medium; and the power supply unit according to any one of (1) to (11), and configured to supply the heater with electric power.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A power supply unit, comprising:

a switching section configured to perform a switching operation and thereby generate, based on an input signal, an alternating-current signal; and a controller configured to control the switching section to perform the switching operation and thereby perform an amplitude control that involves increasing, based on an input current in the switching section, a signal amplitude of the alternating-current signal, the controller determining, based on the input current, a timing of increasing the signal amplitude.

2. The power supply unit according to claim 1, wherein the controller increases the signal amplitude by a predetermined amount, not to allow the input current to exceed a predetermined current value.

3. The power supply unit according to claim 1, wherein the controller controls the switching operation, based on the alternating-current signal.

4. The power supply unit according to claim 1, further comprising a plurality of switches that turn on and off supply of the alternating-current signal to different loads from one another, wherein the controller performs the amplitude control when one or more of the plurality of switches are changed from an off state to an on state.

5. The power supply unit according to claim 1, further comprising a switch that turns on and off supply of the alternating-current signal to a load, wherein the controller performs the amplitude control when the switch is changed from an on state to an off state, and is changed again to the on state after a lapse of predetermined time.

6. The power supply unit according to claim 1, further comprising a power factor correction circuit, wherein the input signal is a direct-current signal, and the power factor correction circuit generates the direct-current signal, based on another alternating-current signal supplied from outside.

7. The power supply unit according to claim 6, further comprising a synchronizing signal generator that generates a synchronizing signal in synchronization with the other alternating-current signal, wherein the controller controls, based on the synchronizing signal, the switching operation to allow a frequency of the alternating-current signal to coincide with a frequency of the other alternating-current signal.

8. The power supply unit according to claim 7, wherein the controller selectively generates, based on the synchronizing signal, one of a first pulse signal and a second pulse signal, the first pulse signal including a plurality of pulses and having a first time length, and the second pulse signal including a plurality of pulses and having a second time length, and the switching section performs the switching operation, based on a pulse signal selected from the first pulse signal and the second pulse signal.

9. The power supply unit according to claim 1, wherein the switching section includes a first switching circuit including a first terminal to which the input signal is supplied, and a second terminal, the first switching circuit turning on and off between the first terminal and the second terminal, and a second switching circuit, including a third terminal coupled to the second terminal of the first switching circuit, and a fourth terminal, the second switching circuit turning on and off between the third terminal and the fourth terminal, and the controller has a first mode and a second mode that involve controlling the switching section not to generate the alternating-current signal, controls, in the first mode, the switching operation to turn off one or both of the first switching circuit and the second switching circuit, and fixes, in the second mode, one or both of the first switching circuit and the second switching circuit to an off state.

10. The power supply unit according to claim 1, wherein the switching section supplies the alternating-current signal to a heater.

11. An image forming apparatus, comprising:

a developing unit;

a fixing unit including a heater, and configured to fix a developer onto a recording medium; and a power supply unit configured to supply the heater with electric power, and including:

a switching section configured to perform a switching operation and thereby generate, based on an input signal, an alternating-current signal; and a controller configured to control the switching section to perform the switching operation and thereby perform an amplitude control that involves increasing, based on an input current in the switching section, a signal amplitude of the alternating-current signal, the controller determining, based on the input current, a timing of increasing the signal amplitude.

12. A power supply unit, comprising:

a switching section including a detection circuit, and configured to perform a switching operation and thereby generate, based on an input signal, an alternating-current signal, the detection circuit being configured to generate a detection signal that changes in response to an input current of the input signal; and a controller configured to control the switching section to perform the switching operation and thereby perform an amplitude control that involves increasing a signal amplitude of the alternating-current signal, the controller performing, based on the detection signal, the amplitude control by changing a timing of the switching operation when a current value of the input current is small.

13. The power supply unit according to claim 12, wherein the controller performs the amplitude control by changing the timing of the switching operation when the current value of the input current is smaller than a predetermined current value.

14. An image forming apparatus, comprising the power supply unit according to claim 12.

* * * * *